US011927415B2

(12) United States Patent
Underwood et al.

(10) Patent No.: US 11,927,415 B2
(45) **Date of Patent: *Mar. 12, 2024**

(54) HYBRID AMBIDEXTROUS RECEIVER

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/880,124

(22) Filed: Aug. 3, 2022

(65) Prior Publication Data

US 2023/0143657 A1 May 11, 2023

Related U.S. Application Data

(63) Continuation of application No. 16/950,562, filed on Nov. 17, 2020, now Pat. No. 11,441,859.

(60) Provisional application No. 63/114,253, filed on Nov. 16, 2020, provisional application No. 62/936,555, filed on Nov. 17, 2019.

(51) Int. Cl.
*F41A 3/66* (2006.01)
*F41A 35/06* (2006.01)

(52) U.S. Cl.
CPC ..... *F41A 3/66* (2013.01); *F41A 35/06* (2013.01)

(58) Field of Classification Search
CPC ..... F41A 17/36; F41A 17/42; F41A 17/38; F41A 35/06; F41A 3/68; F41A 17/40
USPC ..... 89/138
See application file for complete search history.

(56) References Cited

U.S. PATENT DOCUMENTS

| | | | |
|---|---|---|---|
| 3,355,833 | A | 12/1967 | Ruger et al. |
| 4,312,146 | A | 1/1982 | Koon, Jr. |
| 4,539,889 | A | 9/1985 | Glock |
| D285,236 | S | 8/1986 | Brunton |
| 4,879,827 | A | 11/1989 | Gentry |
| 4,941,394 | A | 7/1990 | Zedrosser et al. |
| 5,632,108 | A | 5/1997 | Ruger et al. |
| 5,913,261 | A | 6/1999 | Guhring et al. |
| 6,070,354 | A | 6/2000 | Burigana et al. |
| 6,298,594 | B1 | 10/2001 | Strayer |
| 6,604,311 | B1 | 8/2003 | Laney et al. |
| 6,640,479 | B2 | 11/2003 | Gühring et al. |
| 7,213,359 | B2 | 5/2007 | Beretta |
| 7,814,695 | B1 | 10/2010 | Keeney et al. |
| 7,832,326 | B1 | 11/2010 | Barrett |
| 8,141,287 | B2 | 3/2012 | Dubois |
| 8,230,634 | B1 | 7/2012 | Davies et al. |
| 8,316,756 | B1 | 11/2012 | Woodell et al. |
| 8,387,296 | B2 | 3/2013 | Overstreet et al. |

(Continued)

FOREIGN PATENT DOCUMENTS

WO 2020186181 A1 11/2020

*Primary Examiner* — Reginald S Tillman, Jr.

(57) ABSTRACT

A firearm receiver assembly includes a receiver body, a threaded mount at a rear portion of the receiver body, a magazine release assembly including a magazine release portion on at least one side of the receiver body, a bolt release assembly including a bolt release central portion and a bolt release portion on at least one side of the receiver body, and a safety selector assembly including a safety portion on at least one side of the receiver body. The bolt release central portion translates vertically within a cavity of the receiver body.

21 Claims, 19 Drawing Sheets

(56) References Cited

U.S. PATENT DOCUMENTS

| | | | |
|---|---|---|---|
| 8,464,453 | B1 | 6/2013 | Ubl et al. |
| 8,479,635 | B2 | 7/2013 | Overstreet et al. |
| 8,789,305 | B1 | 7/2014 | DiChario |
| D713,483 | S | 9/2014 | Firpo et al. |
| D717,904 | S | 11/2014 | Oglesby |
| D720,032 | S | 12/2014 | Boutin |
| 8,910,406 | B1 | 12/2014 | Huang et al. |
| 9,032,860 | B2 | 5/2015 | Faxon |
| 9,052,149 | B2 | 6/2015 | Bender |
| 9,068,786 | B2 | 6/2015 | DiChario |
| 9,091,499 | B2 | 7/2015 | Overstreet et al. |
| 9,297,599 | B2 | 3/2016 | Underwood et al. |
| D760,860 | S | 7/2016 | Vincent et al. |
| 9,389,033 | B1 | 7/2016 | Underwood et al. |
| 9,599,419 | B2 | 3/2017 | McGinty |
| 9,863,730 | B2 | 1/2018 | Elftmann |
| 9,927,193 | B2 | 3/2018 | Beasley |
| 9,952,011 | B2 | 4/2018 | Overstreet et al. |
| 9,976,824 | B2 | 5/2018 | Borlaug |
| 10,006,730 | B1 | 6/2018 | Pikielny |
| 10,018,437 | B2 | 7/2018 | Phipps et al. |
| 10,180,298 | B2 | 1/2019 | Noonan |
| 10,184,737 | B2 | 1/2019 | Roberts |
| 10,345,066 | B2 | 7/2019 | Agnelli, Jr. |
| 10,415,913 | B2 | 9/2019 | Wyssen |
| 10,591,234 | B2 | 3/2020 | Beasley |
| 10,598,454 | B2 | 3/2020 | DiChario et al. |
| 10,641,563 | B2 | 5/2020 | Song et al. |
| 10,670,360 | B2 | 6/2020 | Underwood et al. |
| 10,677,552 | B2 | 6/2020 | Wilkinson et al. |
| 10,684,090 | B2 | 6/2020 | Agnelli, Jr. |
| 10,809,024 | B2 | 10/2020 | Johnson, Jr. |
| 10,845,138 | B2 | 11/2020 | Landis et al. |
| 10,890,394 | B2 | 1/2021 | Denson, III et al. |
| 11,125,517 | B2 | 9/2021 | Shreve |
| D943,702 | S | 2/2022 | Underwood et al. |
| 11,300,375 | B2 | 4/2022 | Denson, III et al. |
| 11,320,218 | B2 | 5/2022 | Taylor et al. |
| 11,441,859 | B2 * | 9/2022 | Underwood ..... F41A 35/06 |
| 2005/0011098 | A1 | 1/2005 | Fagundes de Campos |
| 2006/0207149 | A1 | 9/2006 | Lazor |
| 2006/0283067 | A1 | 12/2006 | Herring |
| 2011/0185614 | A1 | 8/2011 | Laney et al. |
| 2011/0214327 | A1 | 9/2011 | DeSomma |
| 2012/0023800 | A1 | 2/2012 | Laney |
| 2012/0111183 | A1 | 5/2012 | Hochstrate et al. |
| 2012/0137562 | A1 | 6/2012 | Langevin et al. |
| 2012/0167424 | A1 | 7/2012 | Gomez |
| 2013/0174457 | A1 | 7/2013 | Gangl et al. |
| 2013/0219763 | A1 | 8/2013 | Nunes |
| 2014/0000142 | A1 | 1/2014 | Patel |
| 2014/0224114 | A1 | 8/2014 | Faxon |
| 2014/0230297 | A1 | 8/2014 | Larson et al. |
| 2014/0331535 | A1 | 11/2014 | Robinson et al. |
| 2014/0352191 | A1 | 12/2014 | Fritz et al. |
| 2015/0000171 | A1 | 1/2015 | Roberts |
| 2015/0020426 | A1 | 1/2015 | Neergaard |
| 2015/0101230 | A1 | 4/2015 | Curtis |
| 2016/0054085 | A1 | 2/2016 | Miller, III |
| 2016/0327357 | A1 | 11/2016 | Wheatley |
| 2017/0082385 | A1 | 3/2017 | Orne, III et al. |
| 2017/0160026 | A1 | 6/2017 | Walther et al. |
| 2017/0299303 | A1 | 10/2017 | Phipps et al. |
| 2018/0087859 | A1 | 3/2018 | Underwood et al. |
| 2018/0347924 | A1 | 12/2018 | Satern |
| 2019/0086168 | A1 | 3/2019 | Song et al. |
| 2019/0226779 | A1 | 7/2019 | DiChario et al. |
| 2021/0270551 | A1 | 9/2021 | Underwood et al. |

* cited by examiner

HYBRID AMBIDEXTROUS RECEIVER

CROSS REFERENCE TO RELATED APPLICATIONS

This application is a continuation of U.S. patent application Ser. No. 16/950,562 ("the '562 application") filed Nov. 17, 2020, which is related to and claims priority benefit from U.S. Provisional Application No. 62/936,555 ("the '555 application"), filed on Nov. 17, 2019 and U.S. Provisional Application No. 63/114,253 ("the '253 application"), filed on Nov. 16, 2020. The '562 application, the '555 application and the '253 application are each hereby incorporated in its entirety by this reference.

FIELD OF THE INVENTION

The field of the invention relates to firearms, particularly receivers for firearms where the receiver is a hybrid design using multiple materials and the receiver is designed with multiple ambidextrous features.

BACKGROUND

Many modern firearms and firearm accessories (including handguns, rifles, carbines, shotguns, etc.) are designed based on existing modular firearm systems. For example, many firearms and related accessories are designed for compatibility with the AR-15 variant (civilian) or M16/M4 (military) firearm platform. Many of these products follow traditional designs based on industry standards and/or military specification (milspec). However, many of the existing components are not compatible with ambidextrous features, are not optimized for different or multiple materials, and require labor-intensive construction and assembly techniques. U.S. Pat. Nos. 9,297,599 and 9,389,033 describe hybrid receiver designs. Each of these two patents is hereby incorporated in its entirety by this reference.

To increase comfort and convenience for a greater number of operators, it may be desirable to design new firearm components or accessories with ambidextrous features. Manufacturing methods utilizing multiple materials to create hybrid parts facilitate the use of specialized materials that more efficiently distribute and dissipate energy while better absorbing vibration and reducing weight for the firearm. Such designs may result in modular firearm components or accessories that increase reliability, reduce perceived recoil, increase safety, and reduce manufacturing/assembly costs.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a firearm receiver assembly comprises: a receiver body; a threaded mount at a rear portion of the receiver body; a magazine release assembly comprising a magazine release portion on at least one side of the receiver body; a bolt release assembly comprising a bolt release central portion and a bolt release portion on at least one side of the receiver body; a safety selector assembly comprising a safety portion on at least one side of the receiver body, wherein the bolt release central portion translates vertically within a cavity of the receiver body.

According to certain embodiments of the present invention, a lower receiver assembly for an AR-15 style firearm comprises: a receiver body comprising a left side and a right side; a threaded mount at a rear portion of the receiver body; a magazine release assembly comprising a first magazine release portion on the left side of the receiver body and a second magazine release portion on the right side of the receiver body; and a bolt release assembly comprising a bolt release portion on at least one side of the receiver body.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments in FIGS. 1A-18 show components of various semi-automatic or automatic rifles, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm, .22 Long Rifle; and shotgun calibers such as, for example, 12 gauge, 20 gauge, 28 gauge, .410 gauge, 10 gauge, 16 gauge. The illustrated embodiments focus on a lower receiver for the AR-15 variant (civilian) or M16/14 (military) firearm platform (i.e., AR-15 style firearms); however, the concepts and features described herein can be are also applicable (with potential necessary alterations for particular applications) to other components of AR-15 style firearms and to components of other firearms.

Figure 1A:
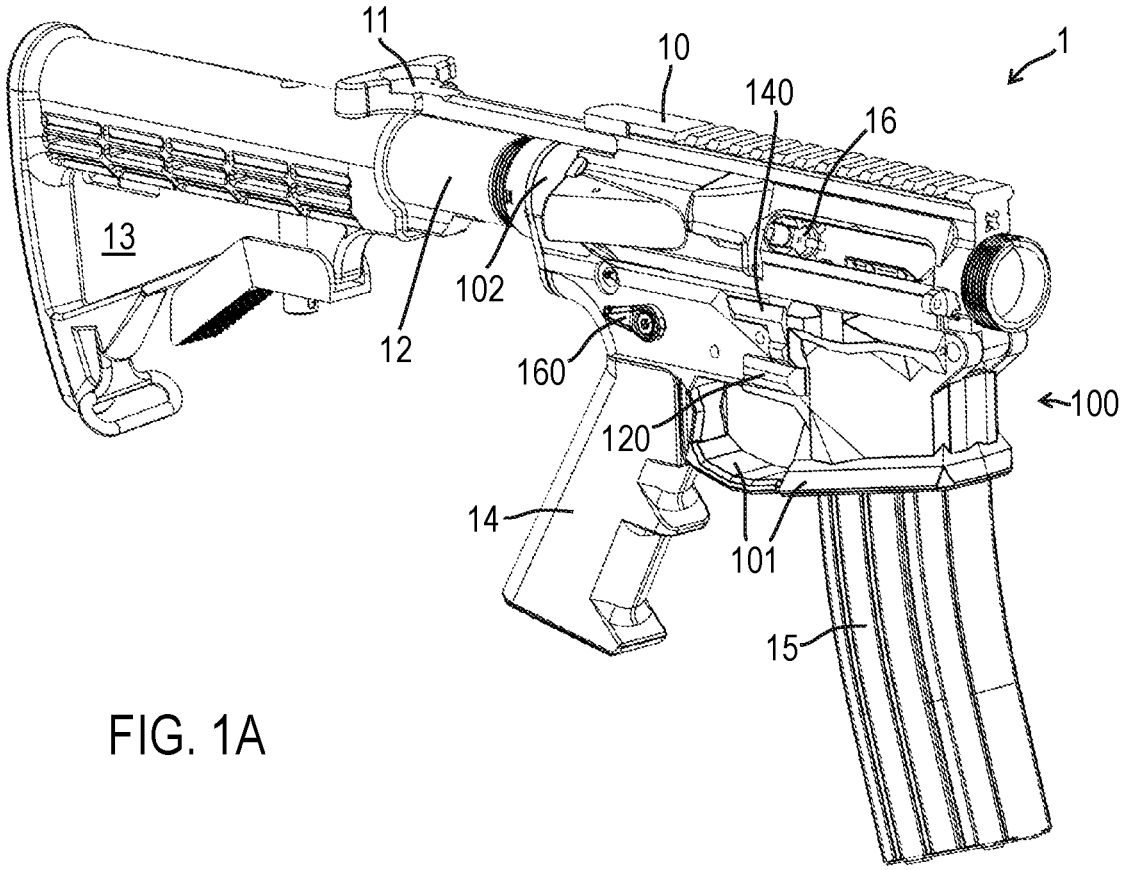
FIG. 1A is a front right perspective view of a firearm according to certain embodiments of the present invention.
Figure 1B:
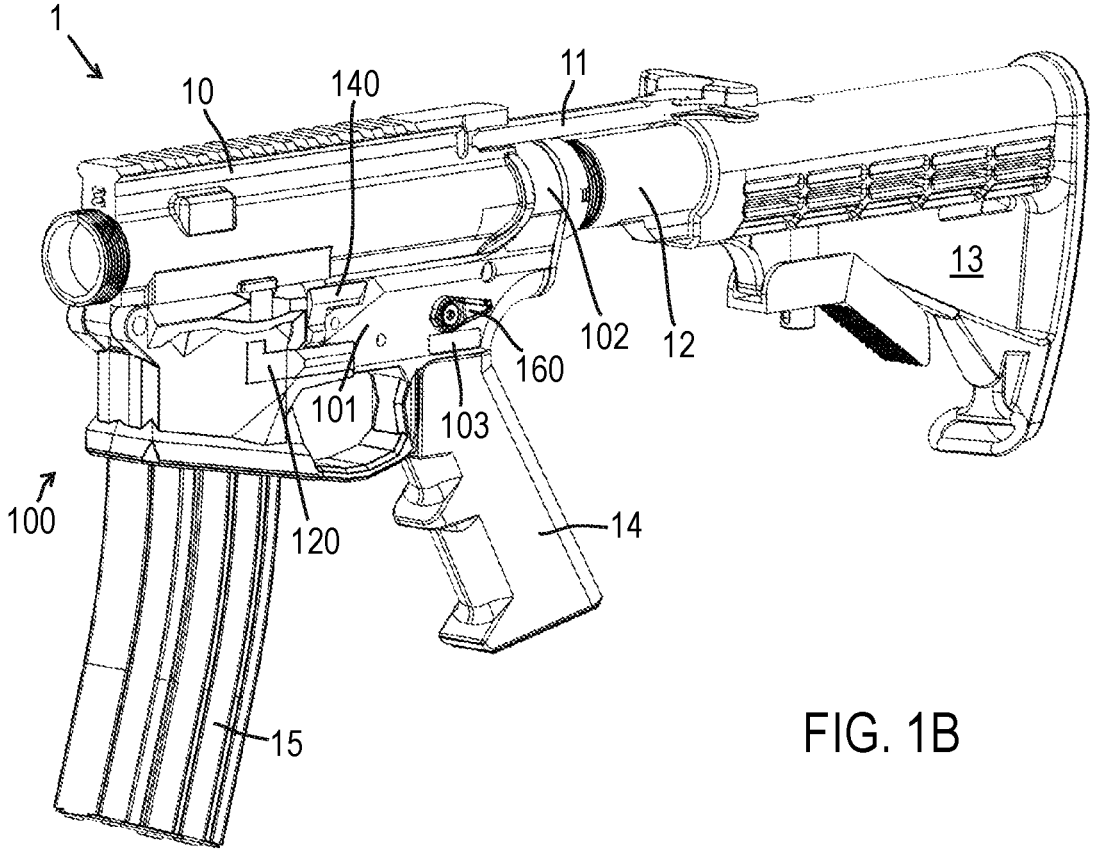
FIG. 1B is a front left perspective view of the firearm of FIG. 1A.

In some cases, a firearm 1 includes a receiver assembly 100, an upper receiver 10, a charging handle 11, a buffer tube 12, a stock 13, a grip 14, a magazine 15, and a bolt carrier group 16 (see FIGS. 1A and 1B). Other components, including, for example, a barrel, a fire control group, and a handguard, are not illustrated for simplicity.

Figure 2A:
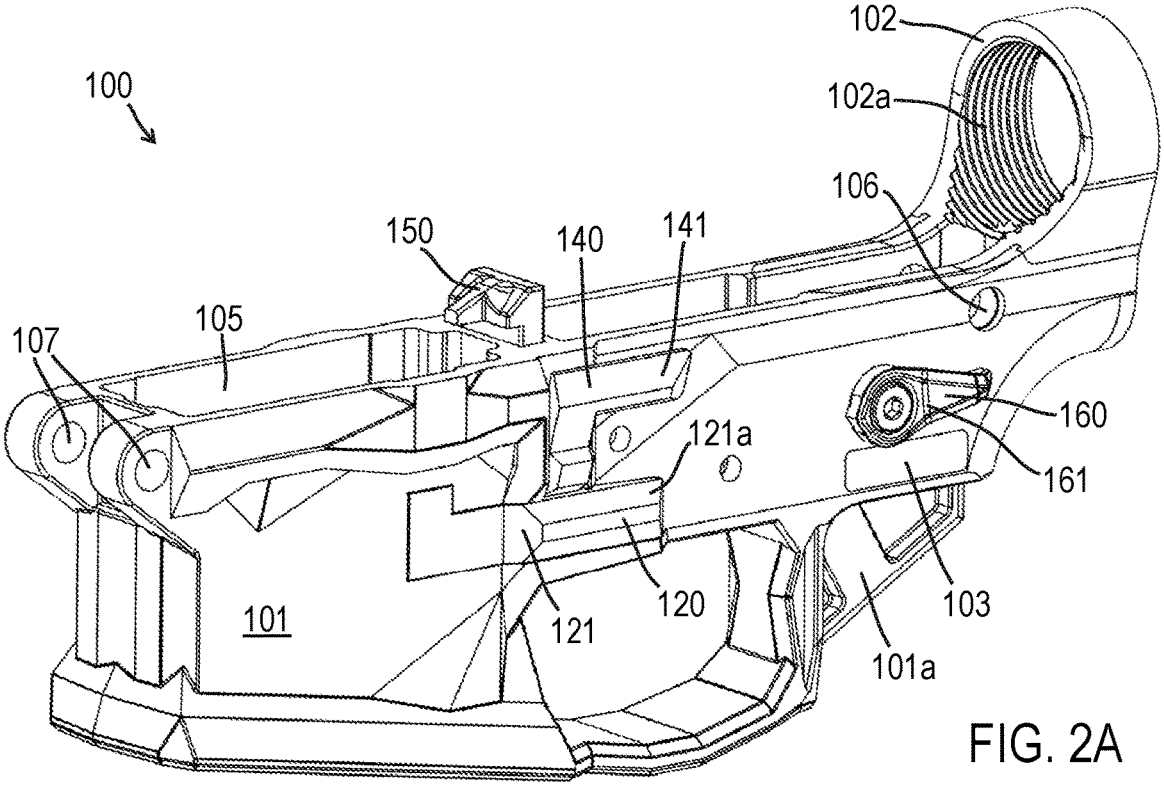
FIG. 2A is a front left perspective view of a receiver assembly of the firearm of FIG. 1A.

According to certain embodiments of the present invention, as shown in FIGS. 1A-1B, the receiver assembly 100 may include a magazine release assembly 120, a bolt release assembly 140, and a safety selector assembly 160. As shown in FIG. 2A, the receiver assembly 100 may also include a receiver body 101, a threaded mount 102, and a magazine well 105. In some embodiments, the receiver assembly 100 interfaces with the upper receiver 10 with two pinned connections including an interface at a takedown pin hole 106 and at a pivot pin hole 107. The takedown pin hole 106 may extend through both the receiver body 101 and the threaded mount 102. The magazine 15 may be capable of being inserted into the magazine well 105 (see FIGS. 1A-2B). In some embodiments, the magazine 15 is a Standardization Agreement (STANAG) magazine (designed for 5.56×45 mm NATO and/or .223 Remington ammunition), a magazine designed for 7.62×35 mm (.300 AAC Blackout), a SR-25 pattern magazine (designed for 7.62×51 mm NATO and/or .308 Winchester ammunition), a STANAG magazine designed for alternative calibers (e.g., pistol calibers including, for example, 9×19 mm, .45 ACP, .40 S&W, .380 ACP, 10 mm Auto, 5.7×28 mm, .22 Long Rifle, etc.), or any other appropriate magazine. The grip 14 may attach to a grip interface portion 101*a* of the receiver body 101. In some embodiments, the grip 14 may be an integral component of the receiver body 101.

Figure 3:
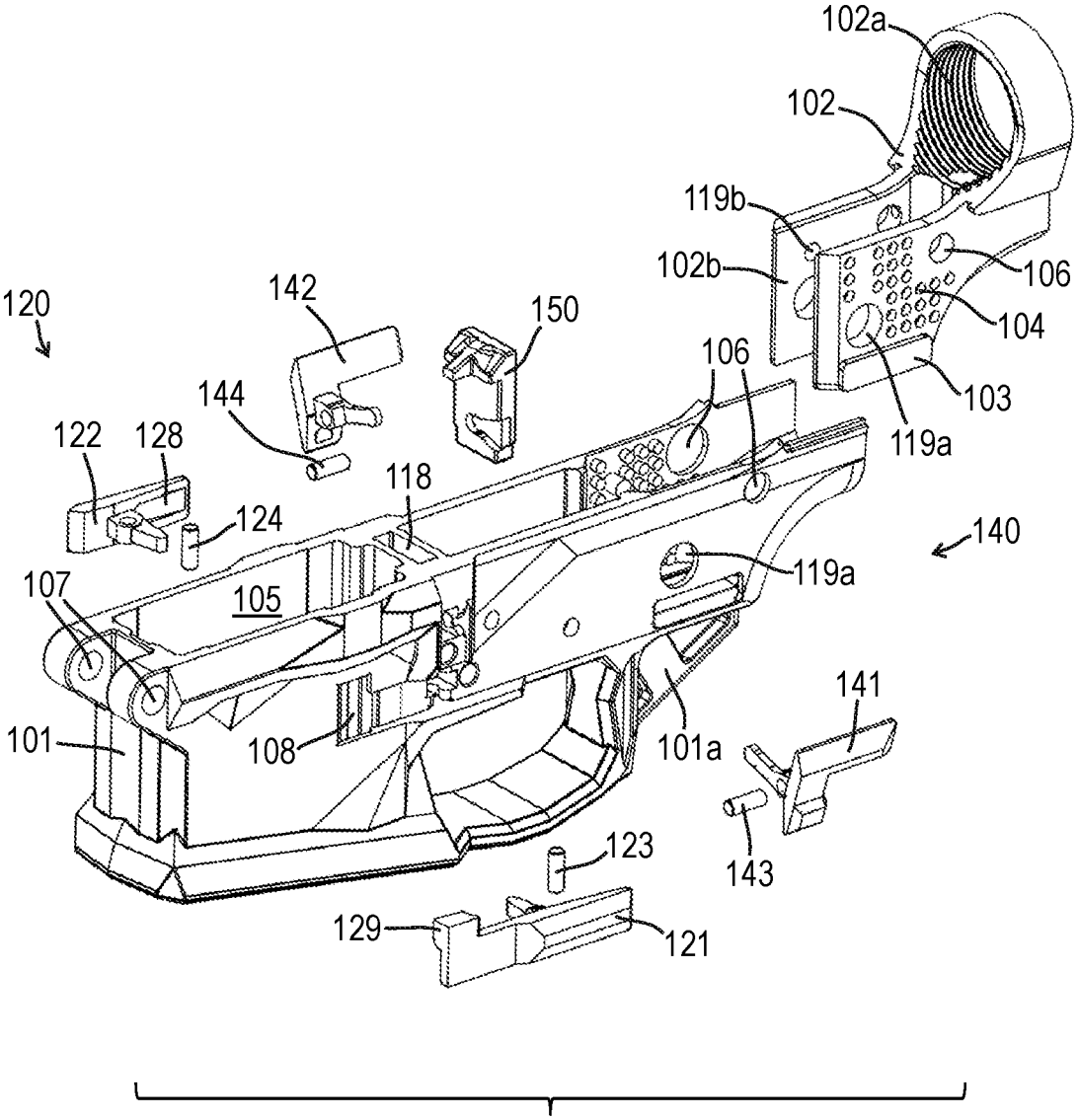
FIG. 3 is an exploded perspective view of the receiver assembly of FIG. 2A.

The threaded mount 102 may be an integral portion of the receiver body 101 (typical for metallic lower receivers) or may be a separate component (e.g., see exploded view in FIG. 3). In some embodiments, the threaded mount 102 and the receiver body 101 are different materials. For example, the threaded mount 102 may be a metallic material and the receiver body 101 may be a non-metallic material, such as a polymer material, a plastic material, a composite material, or any appropriate non-metallic material. In some situations, the stress induced at the threaded connection 102*a* of the threaded mount 102 (i.e., cantilevered attachment of the buffer tube 12) is appropriate for a metallic component. Where the threaded mount 102 and the receiver body 101 are different materials, the receiver body 101 may be molded onto or around the threaded mount 102. For example, the receiver body 101 may be co-molded or injection molded relative to the threaded mount 102. One or both of the takedown pin hole 106 and the safety selector hole 119*a* may be used to locate the threaded mount 102 for the tooling (e.g., an injection molding machine). As shown in FIG. 3, the threaded mount 102 may include a plurality of retaining features 104 such that the material of the receiver body 101 can flow into or otherwise engage the retaining features 104 to ensure sufficient engagement between the threaded mount 102 and the receiver body 101. The threaded mount 102 may also include a serial number plate 103 that protrudes through the receiver body 101 such that the serial number plate 103 is continuous with the outer surface of the receiver body 101 (see FIGS. 1B, 2A, and 3).

For embodiments that include polymer materials for some portion(s) of the receiver assembly 100, the polymer material may improve some characteristics of the firearm 1. For example, compared to some metallic materials (such as aluminum), the polymer material may absorb and dissipate more energy and/or vibration. This results in less energy transferred from the chamber of the firearm (where the cartridge is fired) to the operator (i.e., less recoil). Consequently, after firing a round, the operator can more quickly acquire subsequent targets, which results in greater accuracy for additional shots fired. In other words, some of the energy from firing the cartridge is absorbed in receiver body 101 without being transferred to the operator (where conventional metallic receivers will transfer a greater percentage of the energy to the operator).

In some embodiments, the magazine release assembly 120 includes at least one mechanism for releasing the magazine 15 from the magazine well 105. In particular, the magazine may be released due to movement of the left and/or right side magazine release portions 121, 122. Conventional lower receivers include a button-operated mechanism that releases a magazine based on linear movement where the mechanism can only be operated from the right side of the firearm (designed exclusively for right-handed operators). While the magazine release assembly 120 may include a single mechanism on only one side of the firearm, in some embodiments, the magazine release assembly 120 includes a left side magazine release portion 121 and a right side magazine release portion 122 such that the magazine release assembly 120 is fully ambidextrous. In some embodiments, the left and/or right side magazine release portions 121, 122 may each include a lever mechanism (as described below with vertical pins 123, 124) while in other embodiments, the magazine release assembly 120 includes other modes of operation including, for example, electronic, gear-driven, belt-driven, linear actuators, other mechanical systems, or any other appropriate type of operation. In other words, the magazine release assembly 120 may include at least one pivoting lever.

Figure 4A:
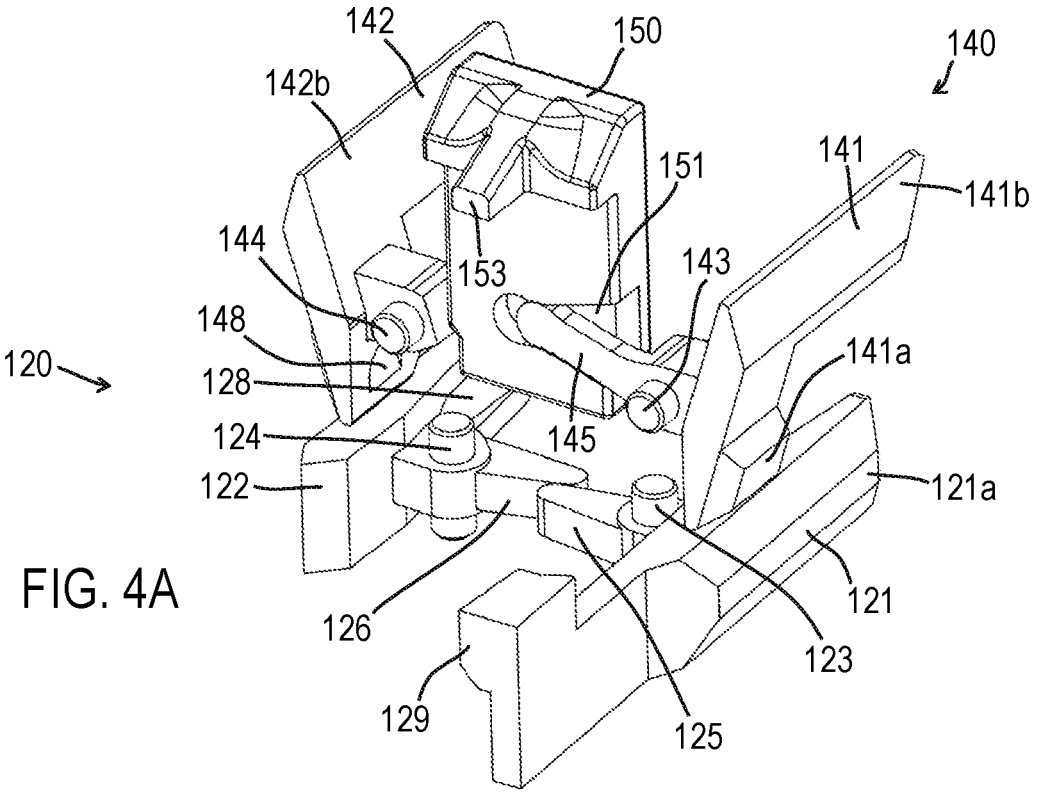
FIG. 4A is a front left perspective view of a magazine release assembly and a bolt release assembly of the firearm of FIG. 1A.
Figure 4B:
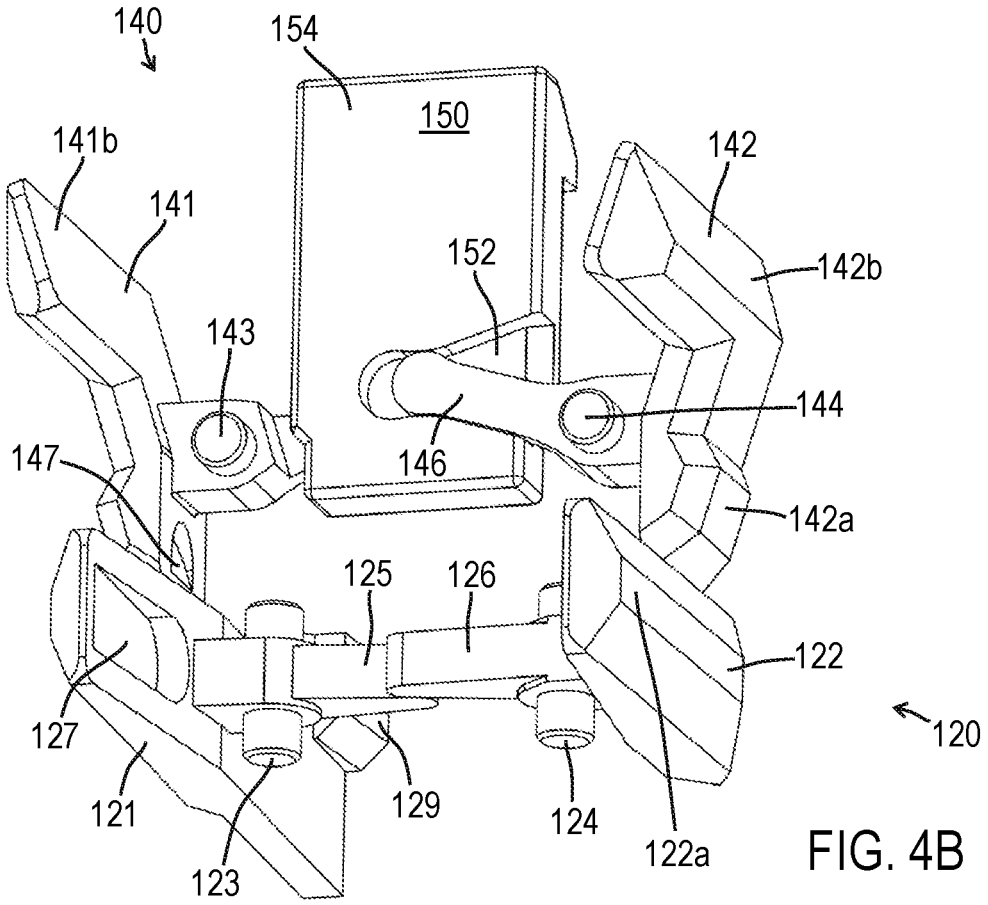
FIG. 4B is a rear right perspective view of the magazine release assembly and the bolt release assembly of FIG. 4A.
Figure 5A:
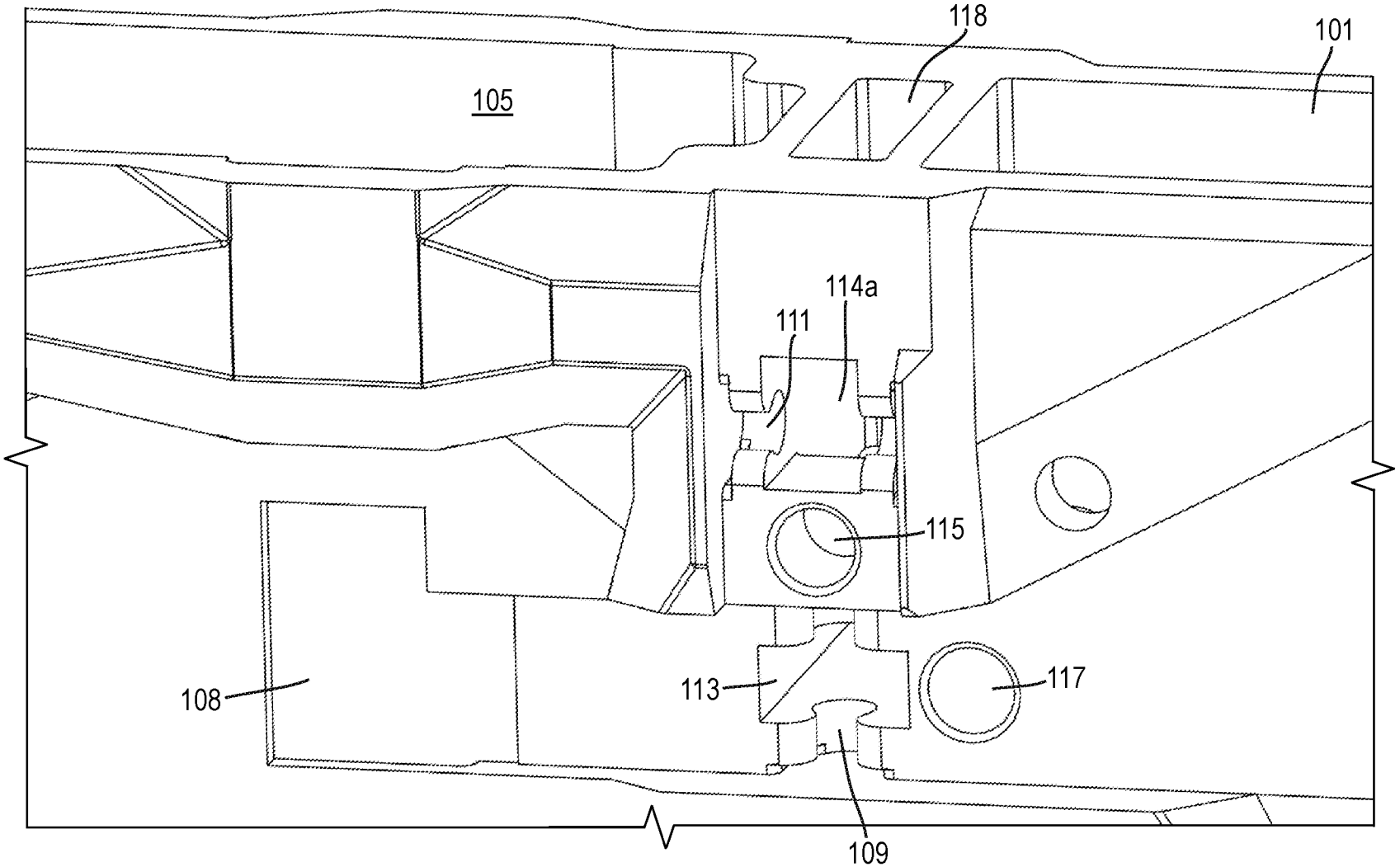
FIG. 5A is a partial perspective view of the left side of a receiver body of the firearm of FIG. 1A.
Figure 5B:
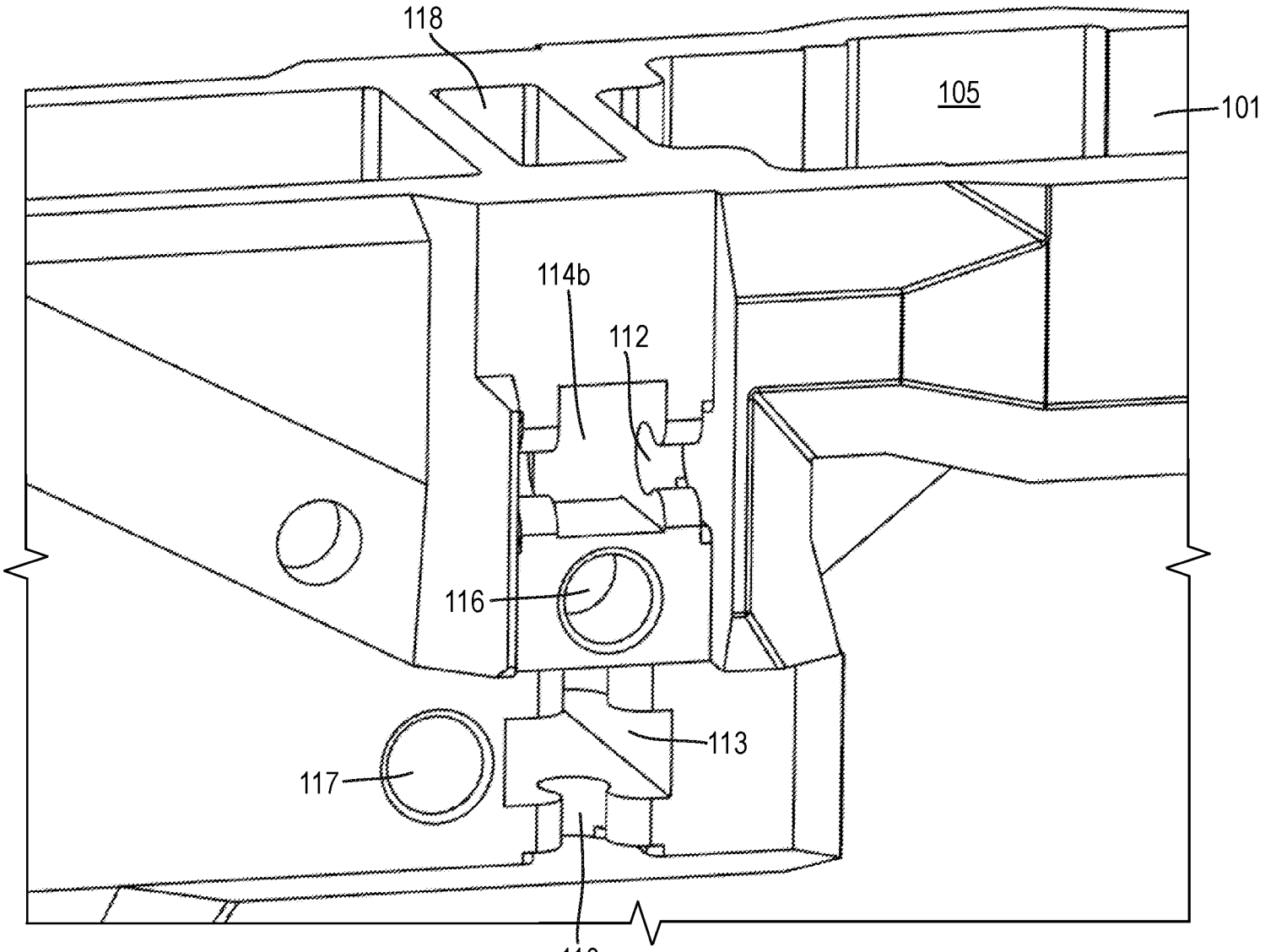
FIG. 5B is a partial perspective view of the right side of the receiver body of FIG. 5A.

As shown in FIG. 2A, the left side magazine release portion 121 may include a rear portion 121*a* closer to the firearm trigger such that the rear portion 121*a* is designed to interface with the operator's left index finger (i.e., the left side magazine release portion 121 is designed for left-handed operators). The forward end of the left side magazine release portion 121 includes a protrusion 129 that extends through hole 108 of the receiver body 101 and engages a corresponding locking recess of the magazine 15 (see FIGS. 3-5A). The protrusion 129 may be compatible with conventional magazines and/or various commercially available magazines including, for example, a Standardization Agreement (STANAG) magazine, designed for 5.56×45 mm NATO ammunition. As shown in FIGS. 3-4B, the left side magazine release portion 121 may include an arm 125 such that the left side magazine release portion 121 is designed to pivot about a vertical axis defined by left side vertical pin 123. The arm 125 may be inserted into passage 113 (see FIG. 5A) and the pin 123 is engaged in a retaining feature 109 that is located above, below, or both above and below the passage 113. In some embodiments, the retaining feature 109 is designed to provide a "snap-fit" such that the left side magazine release portion 121 and pin 123 can be pressed into position (and/or removed) relative to the receiver body 101 without any specialty tools. In some cases, to bias the left side magazine release portion 121 toward engagement with the magazine 15, the magazine release assembly 120 includes a spring within hole 117 such that the spring interfaces with recess 127 of the left side magazine release portion 121 (see FIG. 4B). The left side magazine release portion 121 is biased in the clockwise direction when viewed from above (by the spring in hole 117) such that protrusion 129 is biased toward engagement with the magazine and pressure on the rear portion 121*a* of the left side magazine release portion 121 (e.g., from the operator's left index finger) will cause the left side magazine release portion 121 to rotate in the counter-clockwise direction (against spring pressure) to disengage the protrusion 129 from the corresponding feature of the magazine 15. Rotation of the left side magazine release portion 121 also causes the arm 125 to rotate within the passage 113. In some cases, there is a ball-nosed plunger at the end of the spring (in hole 117) for interfacing with the recess 127. The spring and the ball-nosed plunger are not illustrated for simplicity. In some embodiments, the hole 117 is a through hole that extends through a full width of the receiver body 101; however, in other embodiments, each side of the receiver body 101 includes a separate hole that may or may not align with one another (i.e., there is a separate hole for the left side magazine release portion 121 and the right side magazine release portion 122).

Although the pin 123 is illustrated as a separate component from the left side magazine release portion 121, in some cases, the pin 123 is an integral component of the left side magazine release portion 121. In such a configuration, the left side magazine release portion 121 can be directly attached and/or detached from the retaining feature 109 without any intervening component.

Figure 2B:
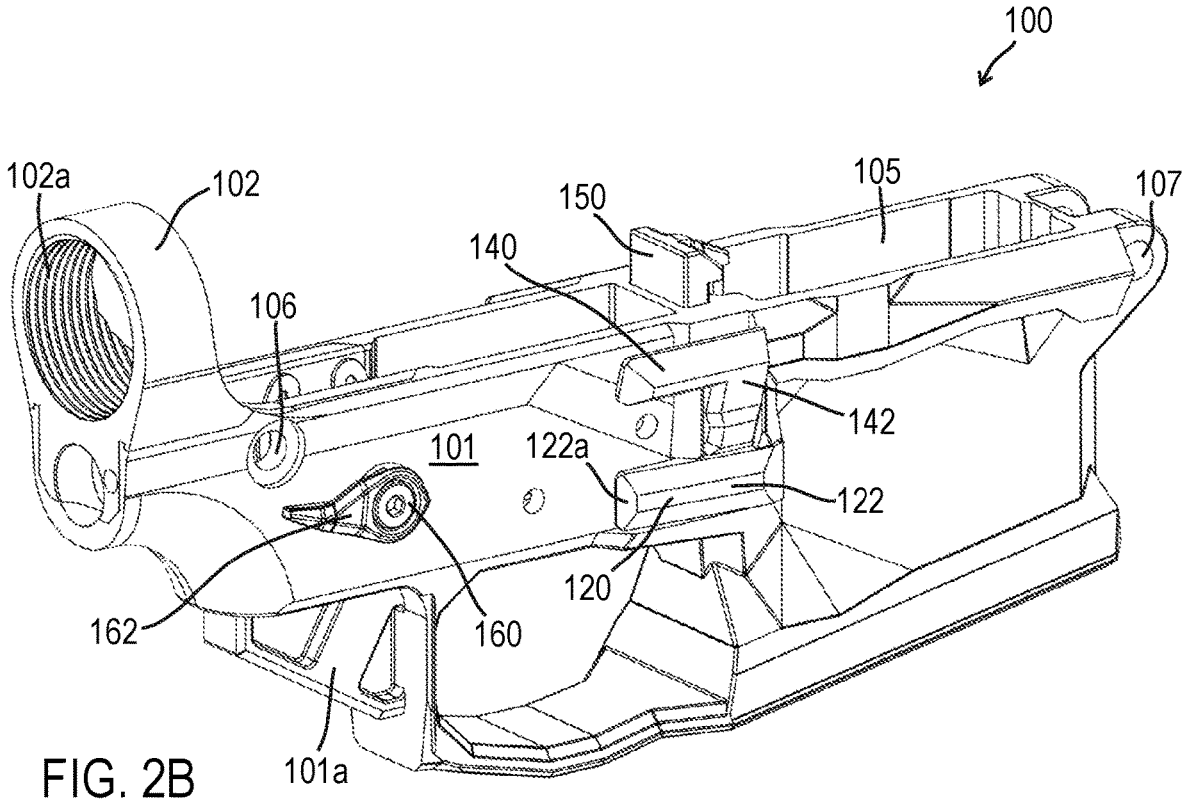
FIG. 2B is a rear right perspective view of the receiver assembly of FIG. 2A.

As shown in FIGS. 2B, the right side magazine release portion 122 includes a rear portion 122*a* adjacent to the firearm trigger such that the rear portion 122*a* is designed to interface with the operator's right index finger (i.e., the right side magazine release portion 122 is designed for right-handed operators). The right side magazine release portion 122 does not extend as far forward as the left side magazine release portion 121 because the relevant feature (i.e., the locking recess of the magazine) is located on the left side. As shown in FIGS. 3-4B, the right side magazine release portion 122 may include an arm 126 such that the right side magazine release portion 122 is designed to pivot about a vertical axis defined by right side vertical pin 124. The arm 126 may be inserted into passage 113 (see FIG. 5B) and the pin 124 is engaged in a retaining feature 110 that is located above, below, or both above and below the passage 113. In some embodiments, the retaining feature 110 is designed to provide a "snap-fit"such that the right side magazine release portion 122 and pin 124 can be pressed into position (and/or removed) relative to the receiver body 101 without any specialty tools. In some cases, to bias the right side magazine release portion 122, the magazine release assembly 120 includes a spring within hole 117 such that the spring interfaces with recess 128 of the right side magazine release portion 122 (see FIGS. 3 and 4A). The right side magazine release portion 122 is biased in the counter-clockwise direction (by the spring in hole 117) such that pressure on the rear portion 122*a* of the right side magazine release portion 122 (e.g., from the operator's right index finger) will cause the right side magazine release portion 122 to rotate in the clockwise direction when viewed from above (against spring pressure). Rotation of the right side magazine release portion 122 causes the arm 126 to rotate within the passage 113 such that the arm 126 presses against arm 125 causing the left side magazine release portion 121 to rotate in the counter-clockwise direction thus causing the protrusion 129 to disengage from the corresponding feature of the magazine 15. In other words, in some cases, movement of the right side magazine release portion 122 causes movement of the left side magazine release portion 121, which results in the disengagement of the protrusion 129 from the magazine 15 (when a magazine is present). In some cases, there is a ball-nosed plunger at the end of the spring (in hole 117) for interfacing with the recess 128. The spring and the ball-nosed plunger are not illustrated for simplicity. As described above, in some examples, the hole 117 is common to both the left side magazine release portion 121 and the right side magazine release portion 122, but this is not always the case.

Although the pin 124 is illustrated as a separate component from the right side magazine release portion 122, in some cases, the pin 124 is an integral component of the right side magazine release portion 122. In such a configuration, the right side magazine release portion 122 can be directly attached and/or detached from the retaining feature 110 without any intervening component.

In some cases, the operator interface portions (rear portion 121*a* and rear portion 122*a*) are symmetric on each side of the receiver assembly 100. Such a configuration ensures consistent operation and ergonomics for each operator, including both right-hand dominant and left-hand dominant operators.

The left and/or right side magazine release portions 121, 122 may be metallic components in some embodiments. In addition, the left and right side vertical pins 123, 124 may be metallic. In other embodiments, at least some portions of the left and right side magazine release portions 121, 122 (and/or the left and right side vertical pins 123, 124) may be a non-metallic material (e.g., polymer).

In some embodiments, the bolt release assembly 140 includes at least one mechanism for manipulating the bolt carrier group 16. In some cases, the bolt carrier group 16 is biased toward a forward end of the firearm (e.g., by a spring within the buffer tube 12). In certain conditions, the bolt release assembly 140 engages and holds the bolt carrier group 16 in a rear position (see FIG. 1A) where the rear surface 154 of the bolt release central portion 150 engages the forward face of the bolt carrier group 16. The bolt release central portion 150 is at least partially located within the cavity 118 of the receiver body 101, and the bolt release central portion 150 can be raised upward due to interface between the forward protrusion 153 and the follower of the magazine 15 or due to the left and/or right side bolt release portions 141, 142.

Conventional lower receivers include a pivoting mechanism that manipulates a bolt carrier group based on rotational movement where the mechanism can only be operated from the left side of the firearm. While the bolt release assembly 140 may include a single mechanism on only one side of the firearm, in some embodiments, the bolt release assembly 140 includes a left side bolt release portion 141 and a right side bolt release portion 142 such that the bolt release assembly 140 is fully ambidextrous. In some embodiments, the left and/or right side bolt release portions 141, 142 may each include a lever mechanism (as described below with pins 143, 144) while in other embodiments, the bolt release assembly 140 includes other modes of operation including, for example, electronic, gear-driven, belt-driven, linear actuators, other mechanical systems, or any other appropriate type of operation. In other words, the bolt release assembly 140 may include at least one pivoting lever.

As shown in FIGS. 4A and 4B, the left side bolt release portion 141 includes a lower portion 141*a* and an upper portion 141*b* (designed for an operator to manipulate the left side bolt release portion 141) along with an arm 145 and is designed to pivot about a forward/aft axis defined by left side pin 143. In some embodiments, the arm 145 may be inserted into passage 114*a* (see FIG. 5A) which intersects cavity 118, and the pin 143 is engaged in a retaining feature 111 that is located forward, aft, or both forward and aft of the passage 114*a*. The arm 145 engages a front cutout 151 of the bolt release central portion 150. In some embodiments, the retaining feature 111 is designed to provide a "snap-fit" such that the left side bolt release portion 141 and pin 143 can be pressed into position (and/or removed) relative to the receiver body 101 without any specialty tools. Pressing the lower portion 141*a* causes the left side bolt release portion 141 to rotate about the left side pin 143 such that the arm 145 pivots and causes the bolt release central portion 150 to move upward (i.e., toward a position where the bolt release central portion 150 would engage the bolt carrier group 16). Similarly, pressing the upper portion 141*b* causes the left side bolt release portion 141 to rotate about the left side pin 143 such that the arm 145 pivots and causes the bolt release central portion 150 to move downward (i.e., away from a position where the bolt release central portion 150 would engage the bolt carrier group 16). In some cases, the bolt release assembly 140 includes a spring within hole 115 such that the spring interfaces with recess 147 of the left side bolt release portion 141 (see FIG. 4B) to bias the bolt release central portion 150 downward such that the bolt carrier group 16 can move past the bolt release assembly 140. In some embodiments, the bolt release central portion 150 translates or moves linearly (i.e., does not rotate).

Although the pin 143 is illustrated as a separate component from the left side bolt release portion 141, in some cases, the pin 143 is an integral component of the left side bolt release portion 141. In such a configuration, the left side bolt release portion 141 can be directly attached and/or detached from the retaining feature 111 without any intervening component.

As shown in FIGS. 4A and 4B, the right side bolt release portion 142 includes a lower portion 142*a* and an upper portion 142*b* (designed for an operator to manipulate the right side bolt release portion 142) along with an arm 146 and is designed to pivot about a forward/aft axis defined by right side pin 144. In some embodiments, the arm 146 may be inserted into passage 114*b* (see FIG. 5B) which intersects cavity 118, and the pin 144 is engaged in a retaining feature 112 that is located forward, aft, or both forward and aft of the passage 114*b*. The arm 146 engages a rear cutout 152 of the bolt release central portion 150. In some embodiments, the retaining feature 112 is designed to provide a "snap-fit" such that the right side bolt release portion 142 and pin 144 can be pressed into position (and/or removed) relative to the receiver body 101 without any specialty tools. Pressing the lower portion 142*a* causes the right side bolt release portion 142 to rotate about the right side pin 144 such that the arm 146 pivots and causes the bolt release central portion 150 to move upward (i.e., toward a position where the bolt release central portion 150 would engage the bolt carrier group 16). Similarly, pressing the upper portion 142*b* causes the right side bolt release portion 142 to rotate about the left side pin 144 such that the arm 146 pivots and causes the bolt release central portion 150 to move downward (i.e., away from a position where the bolt release central portion 150 would engage the bolt carrier group 16). In some cases, the bolt release assembly 140 includes a spring within hole 116 such that the spring interfaces with recess 148 of the right side bolt release portion 142 (see FIG. 4A) to bias the bolt release central portion 150 downward such that the bolt carrier group 16 can move past the bolt release assembly 140. Accordingly, the bolt release assembly 140 may include two springs acting together to bias the bolt release central portion 150 downward (i.e., one spring interfacing with recess 147 of the left side bolt release portion 141 and a second spring interfacing with recess 148 of the right side bolt release portion 142). In some embodiments, the bolt release central portion 150 translates or moves linearly (i.e., does not rotate).

Although the pin 144 is illustrated as a separate component from the right side bolt release portion 142, in some cases, the pin 144 is an integral component of the right side bolt release portion 142. In such a configuration, the right side bolt release portion 142 can be directly attached and/or detached from the retaining feature 112 without any intervening component.

Based on the movement of at least one of arms 145, 146 (as described above), and/or the follower of the magazine 15 pushing on forward protrusion 153, the bolt release central portion 150 moves approximately vertically within cavity 118. In other words, the bolt release central portion 150 translates approximately vertically (i.e., linearly) within cavity 118, while conventional bolt release mechanisms pivot (without translating).

In some cases, the operator interface portions for raising the bolt release central portion 150 (lower portion 141*a* and lower portion 142*a*) are symmetric on each side of the receiver assembly 100. Similarly, the operator interface portions for lowering the bolt release central portion 150 (upper portion 141*b* and upper portion 142*b*) are symmetric on each side of the receiver assembly 100. Such a configuration ensures consistent operation and ergonomics for each operator, including both right-hand dominant and left-hand dominant operators.

The left and/or right side bolt release portions 141, 142 may be metallic components in some embodiments. In addition, the left and right side pins 143, 144 may be metallic. In other embodiments, at least some portions of the left and right side bolt release portions 141, 142 (and/or the left and right side pins 143, 144) may be a non-metallic material (e.g., polymer).

As shown in FIGS. 1A-3, the safety selector assembly 160 may interface with the safety selector hole 119*a*. The safety selector assembly 160 includes at least one safety portion, and, in some cases, includes a left side safety portion 161 and a right side safety portion 162 such that the safety selector assembly 160 is fully ambidextrous. In addition to the left side safety portion 161 and the right side safety portion 162, the safety selector assembly 160 (see FIGS. 6A and 6B) may include a selector shaft 181, a selector cap 182, a detent clip 170, and at least one fastener 198, 199. Conventional safety assemblies include a detent and spring that pass through a vertical hole in the receiver body 101 that aligns with the pistol grip 14. The safety selector assembly 160 is compatible with typical detent and spring arrangements where the detent interfaces with the radial slot 192 of the selector shaft 181. However, the safety selector assembly 160 may include an improved arrangement for constraining and dictating motion for the safety assembly (i.e., the assembly can function without the typical detent and spring). At the right end of the safety selector assembly 160, a first end of the selector shaft 181 has an outer diameter that approximately matches the inner diameter of the safety selector hole 119*a*. The first end may also include a recess 183 that approximately matches the protrusion 166 of the right side safety portion 162 such that when the right side safety portion 162 and the selector shaft 181 are rotationally constrained with one another. The fastener 199 passes through hole 169 of the right side safety portion 162 and threads into hole 169 at the right end of the selector shaft 181.

At the left end of the safety selector assembly 160, the selector cap 182 has an outer diameter that approximately matches the inner diameter of the safety selector hole 119*a*. The outer face of the selector cap 182 may also include a recess 184 that approximately matches the protrusion on the inner surface of the left side safety portion 161 (similar to the protrusion 166 of the right side safety portion 162) such that the left side safety portion 161, the selector cap 182, and the selector shaft 181 are rotationally constrained with one another. The fastener 198 passes through hole 169 of the left side safety portion 161 and through hole 169 of the selector cap 182 before threading into hole 169 at the left end of the selector shaft 181.

In some embodiments, the left end of the selector shaft 181 includes at least one protrusion that extends from surface 189*a*. The protrusion may have any appropriate shape including, but not limited to, cylindrical. The protrusion may facilitate the assembly process such that the protrusion limits movement of the first arm 173 and/or the second arm 174 relative to the selector shaft 181.

The selector cap 182 and the selector shaft 181 interface with one another near the inner surface 102*b* of the threaded mount 102. The selector cap 182 includes at least one protrusion 187 where the protrusion(s) 187 engage the open portions 185, 186 at the left end of the selector shaft 181. In addition, the detent clip 170 is arranged against the inner surface 102*b* of the threaded mount 102 such that the protrusion 171 engages the inner hole 119*b* adjacent to the safety selector hole 119*a* and the arch section 172 engages the outer surface 181*a* at the left end of the selector shaft 181. In the assembled state, the detent clip 170 is sandwiched between (i) the end surface 189 of the selector shaft 181 and (ii) the inner surface 102*b* of the threaded mount 102. As shown in FIGS. 6B and 6E, the detent clip 170 includes a first arm 173 and a second arm 174. The first arm 173 includes a first protrusion 175 where the first protrusion 175 has an inner surface 175*a* and an outer surface 175*b*. The second arm 174 includes a second protrusion 176 where the second protrusion 176 has an inner surface 176*a* and an outer surface 176*b*.

The left side safety portion 161 includes a finger interface portion 163 and an indicator protrusion 167 that points toward a symbol or other indicator (e.g., text) on the surface of the receiver body 101. In some cases, the indicator protrusion 167 points toward the forward end of the firearm (see FIGS. 1A-2B, 6A, and 6B) when the safety selector assembly 160 is in the safe condition. Similarly, the right side safety portion 162 includes a finger interface portion 164 and an indicator protrusion 168 that points toward a symbol or other indicator (e.g., text) on the surface of the receiver body 101. In some cases, the indicator protrusion 168 points toward the forward end of the firearm (see FIGS. 1A-2B, 6A, and 6B) when the safety selector assembly 160 is in the safe condition. In some cases, the indicator protrusion 167 points toward the top of the firearm when the safety selector assembly 160 is in the fire condition. Similarly, the indicator protrusion 168 may point toward the top of the firearm when the safety selector assembly 160 is in the fire condition.

In some cases, the operator interface portions (finger interface portion 163 and finger interface portion 164) are symmetric on each side of the receiver assembly 100. Such a configuration ensures consistent operation and ergonomics for each operator, including both right-hand dominant and left-hand dominant operators.

In some embodiments, the interface between the safety selector assembly 160 and the fire control group (and the resultant condition of the safety selector assembly 160) is based on rotation of the selector shaft 181. For a description of the function of a fire control group, see U.S. Pat. No. 10,670,360, which is hereby incorporated in its entirety by this reference. When the cylindrical surface 190 of the selector shaft 181 (see FIGS. 6F and 6G) faces downward (i.e., toward the grip interface portion 101*a*), the safety selector assembly 160 prevents rotation of the trigger (i.e., safe condition). When the selector shaft 181 is rotated such that the planar surface 191 of the selector shaft 181 (see FIGS. 6F and 6G) faces downward (i.e., toward the grip interface portion 101*a*), the safety selector assembly 160 allows rotation of the trigger (i.e., fire condition).

Figure 6A:
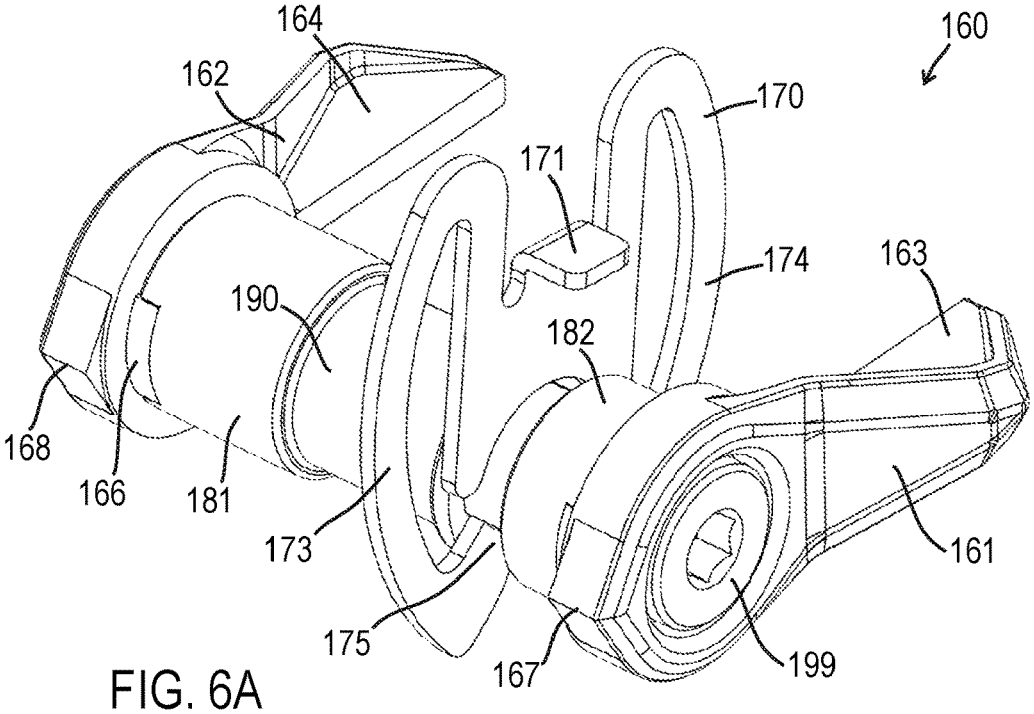
FIG. 6A is a front left perspective view of a safety selector assembly of the firearm of FIG. 1A.
Figure 6B:
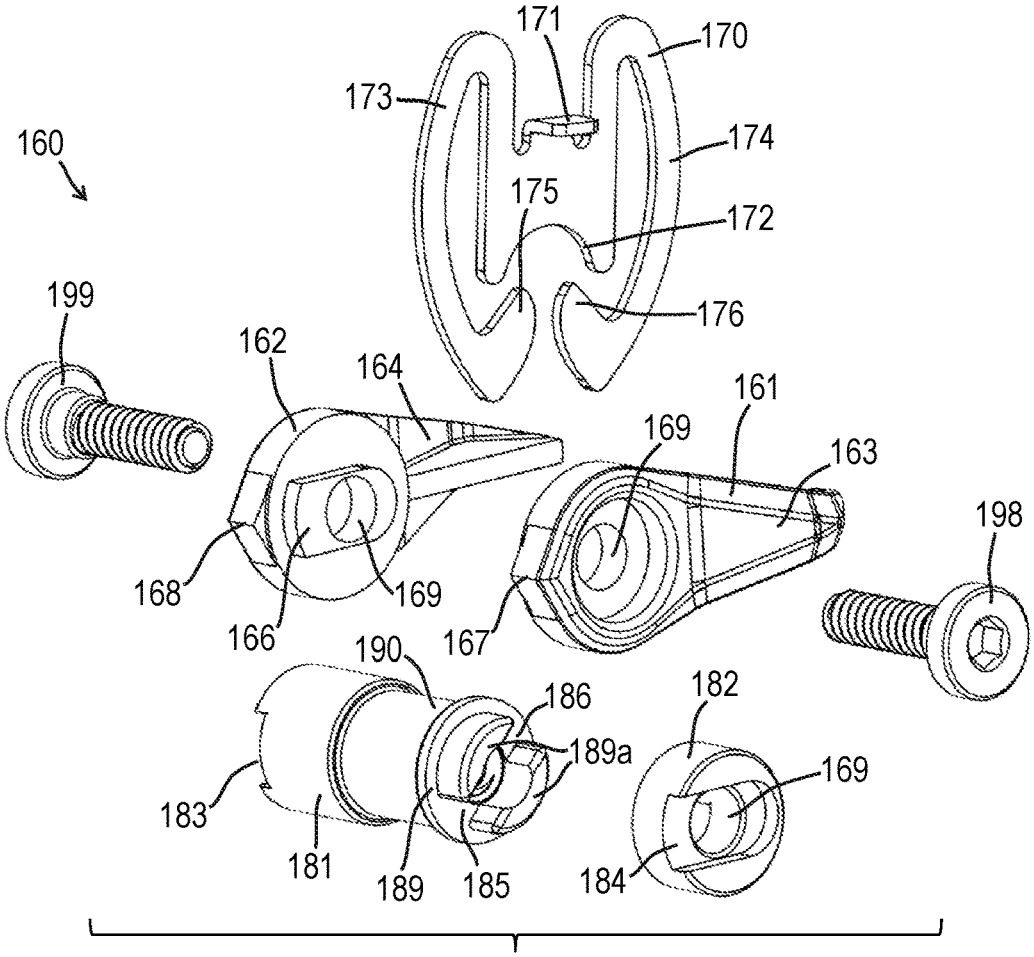
FIG. 6B is an exploded perspective view of the safety selector assembly of FIG. 6A.
Figure 6C:
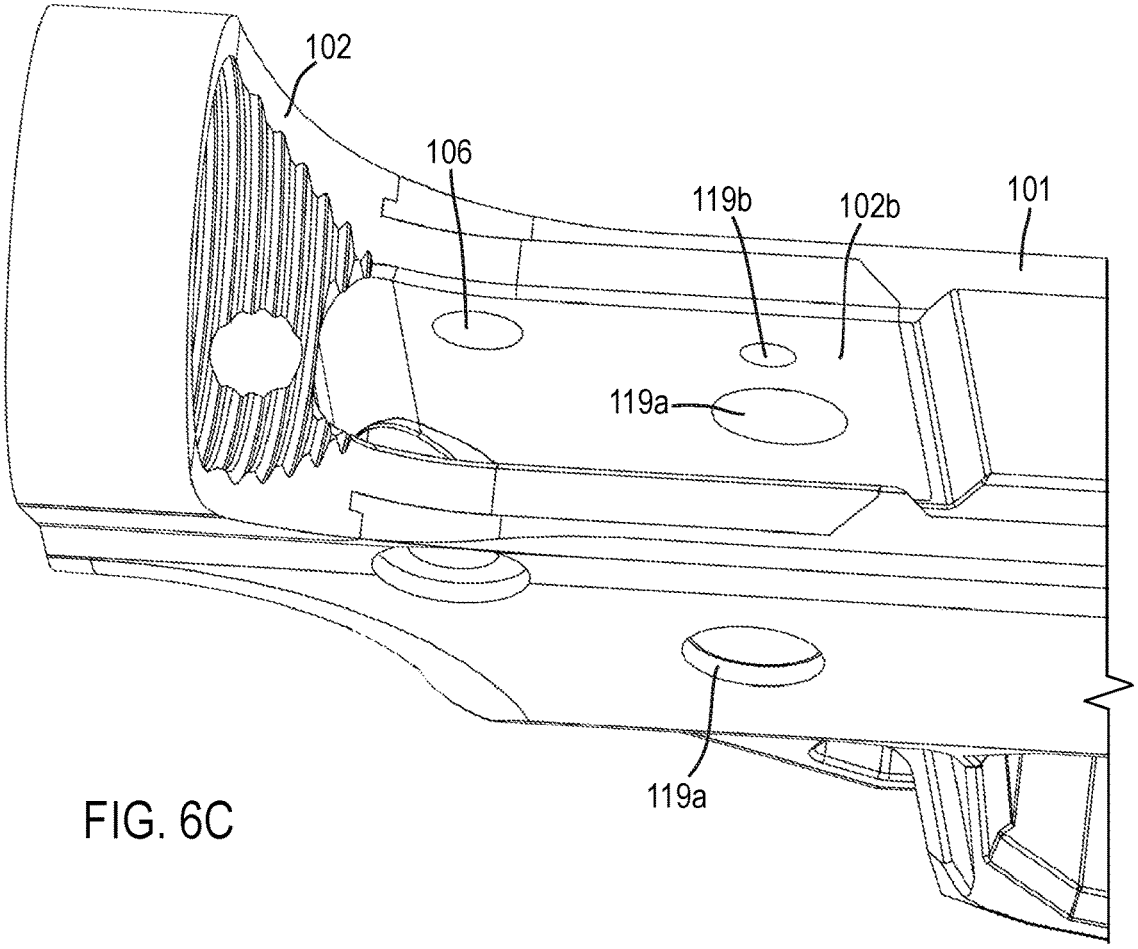
FIG. 6C is a partial perspective view of the right side of the receiver body of the firearm of FIG. 1A.
Figure 6D:
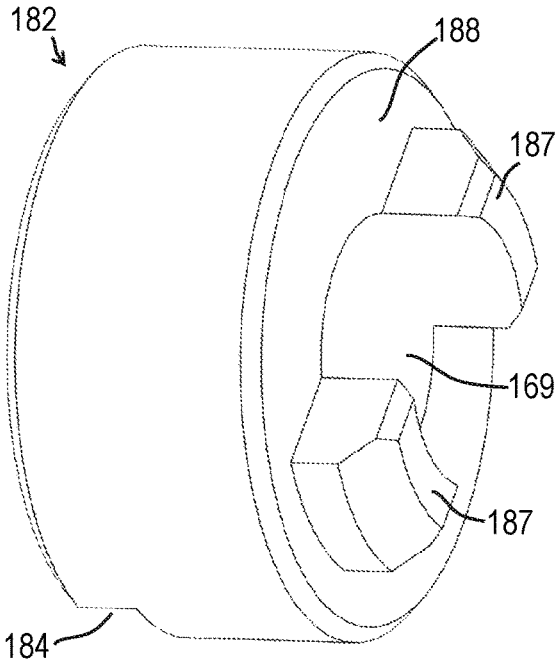
FIG. 6D is a perspective view of a selector cap of the safety selector assembly of FIG. 6A.
Figure 6E:
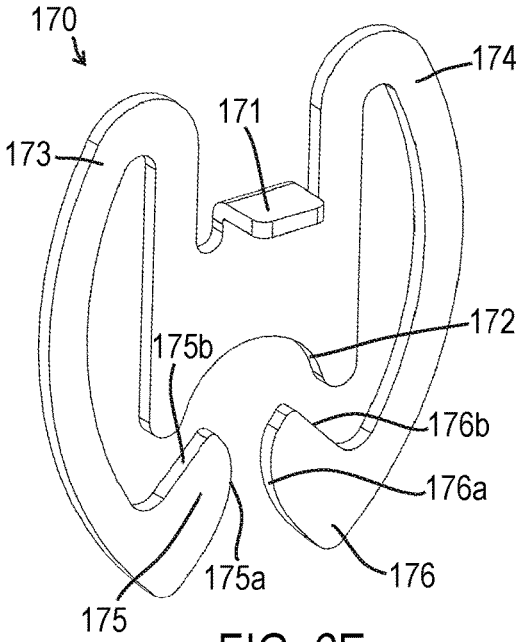
FIG. 6E is a perspective view of a detent clip of the safety selector assembly of FIG. 6A.
Figure 6F:
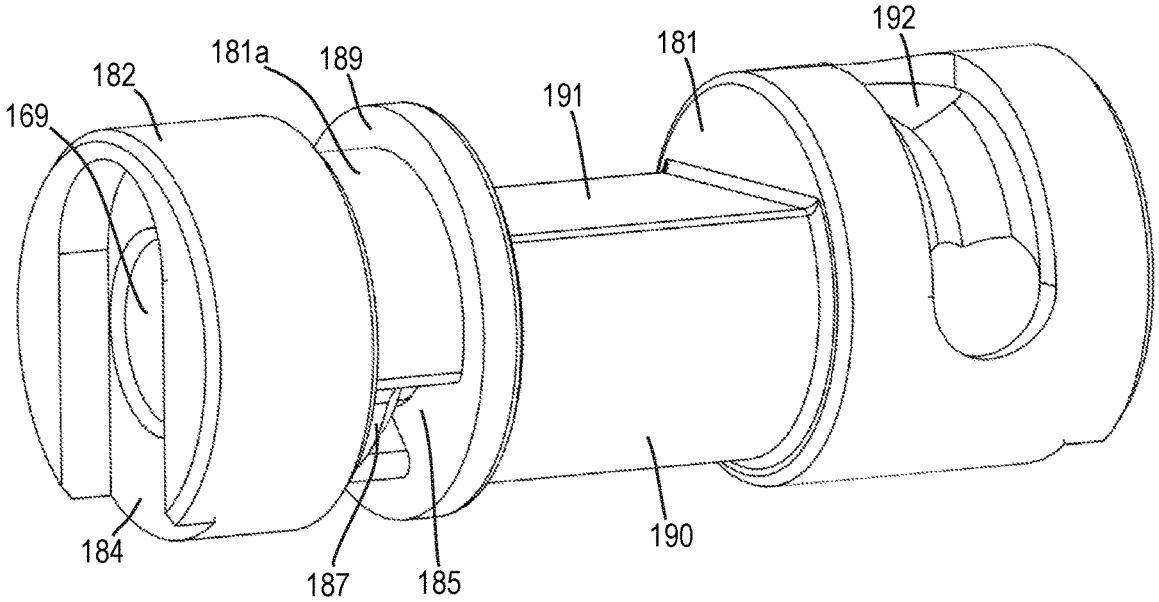
FIGS. 6F and 6G are perspective views of the selector cap and a selector shaft of the safety selector assembly of FIG. 6A.
Figure 6G:
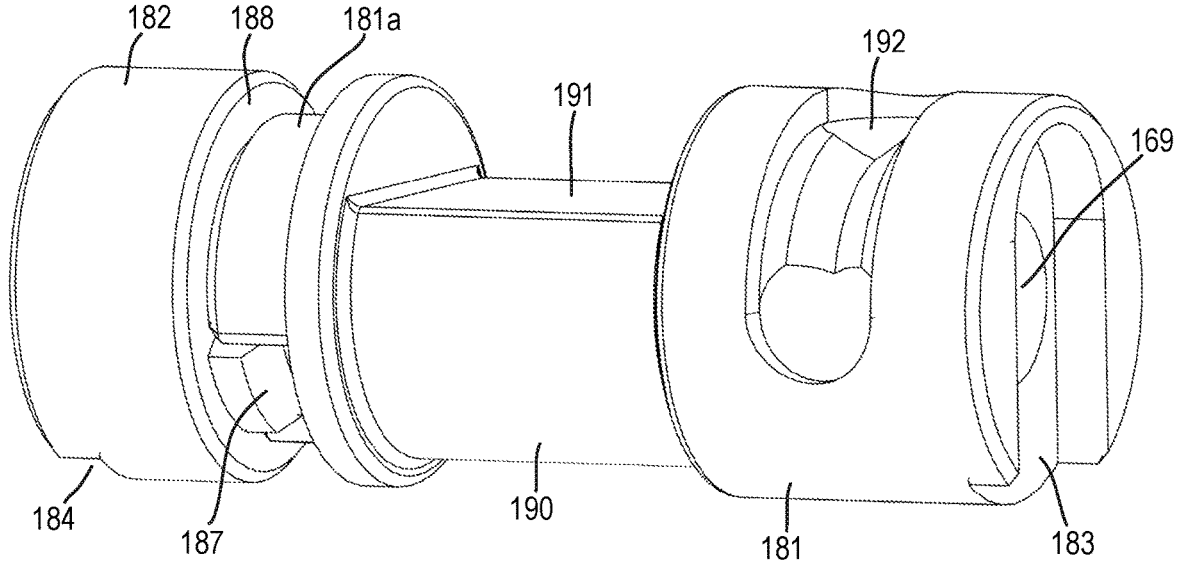

When the safety selector assembly 160 is in the safe condition, the first protrusion 175 of the first arm 173 engages the open portion 185 of the selector shaft 181 (see FIGS. 6A and 6B). The first protrusion 175 acts as a detent because the detent clip 170 functions as a spring where the first arm 173 and the second arm 174 are biased toward converging inward to one another. The detent clip 170 cannot rotate with the selector shaft 181 because the protrusion 171 engages the inner hole 119*b*. Based on the geometry of the first protrusion 175, the safety selector assembly 160 can only rotate one direction from the safe condition. If the operator tries to rotate the safety selector assembly 160 to point the indicator protrusions 167, 168 downward (i.e., toward the grip interface portion 101*a*), the outer surface 175*b* engages the adjacent inner surface of the open portion 185 and thus prevents rotation of the safety selector assembly 160. If the operator tries to rotate the safety selector assembly 160 to point the indicator protrusions 167, 168 upward (i.e., away from the grip interface portion 101*a*), rotation of the safety selector assembly 160 causes the inner surface 175*a* to press against the adjacent inner surface of the open portion 185. Based on the geometry of the inner surface 175*a*, the interface between the inner surface of the open portion 185 and the inner surface 175*a* causes the first arm 173 to deflect away from the selector shaft 181 thus allowing rotation of the safety selector assembly 160. The safety selector assembly 160 can rotate approximately 90° until the second protrusion 176 (of the second arm 174) engages the open portion 186. Like the first protrusion 175, the second protrusion 176 acts as a detent because the second arm 174 is biased toward engaging the open portion 186. When the second protrusion 176 engages the open portion 186, the safety selector assembly 160 is in the fire condition.

When the safety selector assembly 160 is in the fire condition, the second protrusion 176 of the second arm 174 engages the open portion 186. The second protrusion 176 acts as a detent because the detent clip 170 functions as a spring where the first arm 173 and the second arm 174 are biased toward converging towards one another. The detent clip 170 cannot rotate with the selector shaft 181 because the protrusion 171 engages the inner hole 119*b*. Based on the geometry of the second protrusion 176, the safety selector assembly 160 can only rotate one direction from the fire condition. If the operator tries to rotate the safety selector assembly 160 to point the indicator protrusions 167, 168 rearward (i.e., toward the threaded mount 102), the outer surface 176*b* engages the adjacent inner surface of the open portion 186 and thus prevents rotation of the safety selector assembly 160. If the operator tries to rotate the safety selector assembly 160 to point the indicator protrusions 167, 168 forward (i.e., toward the magazine 15), the inner surface 176*a* presses against the adjacent inner surface of the open portion 186. Based on the geometry of the inner surface 176*a*, the interface between the inner surface of the open portion 186 and the inner surface 176*a* causes the second arm 174 to deflect away from the selector shaft 181 thus allowing rotation of the safety selector assembly 160. The safety selector assembly 160 can rotate approximately 90° until the second protrusion 175 engages the open portion 185 (i.e., the safe condition described above).

Figure 16:
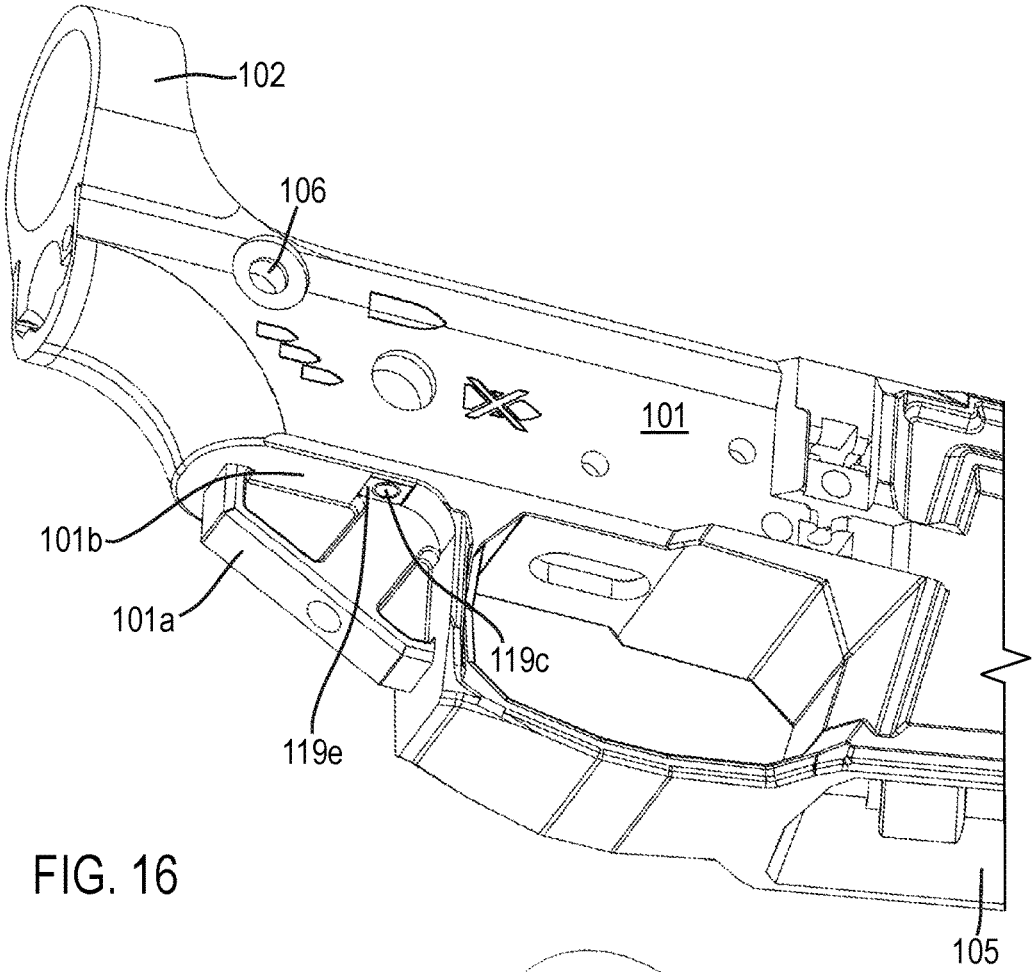
FIG. 16 is a rear right lower perspective partial view of a receiver assembly of the firearm of FIG. 1A.
Figure 17A:
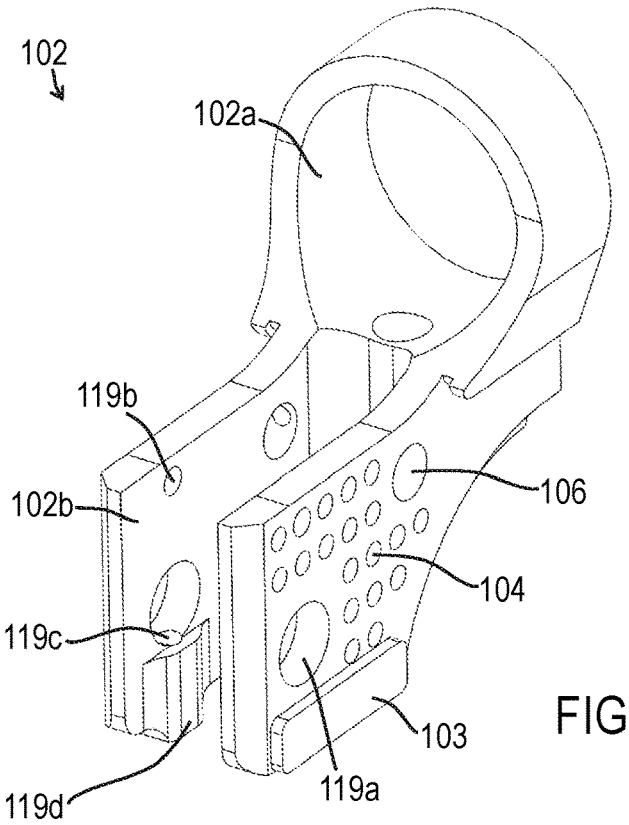
FIG. 17A is a front left perspective view of a threaded mount of the firearm of FIG. 1A.
Figure 17B:
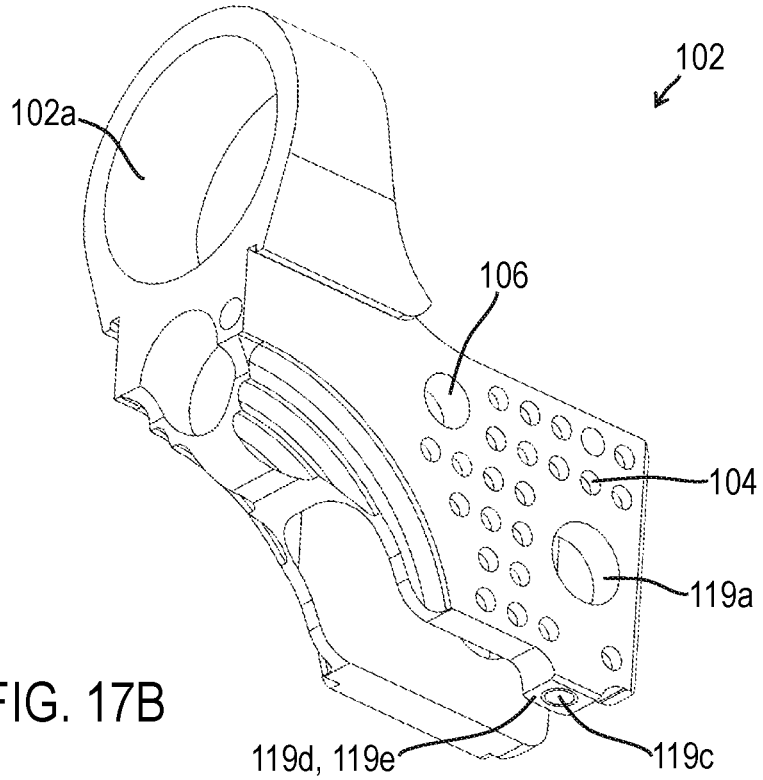
FIG. 17B is a rear right perspective view of the threaded mount of FIG. 17A.
Figure 18:
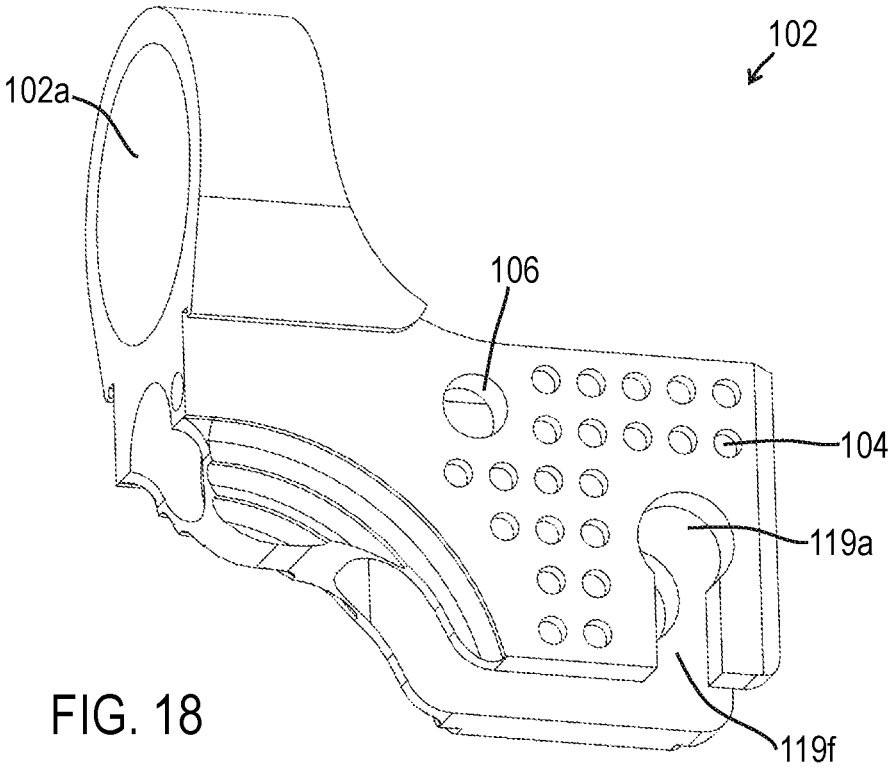
FIG. 18 is a rear right perspective view of a threaded mount of the firearm of FIG. 1A.

In some embodiments, the threaded mount 102 includes provisions for safety selector components that extend upward from the grip interface portion 101*a*. For example, as shown in FIGS. 16-17B, the threaded mount 102 may include a hole 119*c* that extends in an approximately vertical direction where a lower end of the hole 119*c* extends to a lower surface 101*b* of the receiver body 101. The upper end of hole 119*c* may extend to and/or intersect with the safety selector hole 119*a*. As shown in FIG. 16, the threaded mount 102 may include a lower surface 119*e* that is approximately continuous and/or coplanar with the lower surface 101*b* of the receiver body 101. The threaded mount 102 may include a protrusion that extends in at least one direction in the area adjacent to hole 119*c*. For example, as shown in FIGS. 17A and 17B, the threaded mount 102 may include a protrusion in the lateral direction (inward) and vertically (down). In some embodiments, a detent and a spring are inserted into hole 119*c* from the bottom and are held in position by the grip 14. The detent and spring are not shown for clarity. In some embodiments, as shown in FIG. 18, the threaded mount 102 includes a gap 119*f* in the area below the safety selector hole 119*a*. The gap 119*f* allows a feature (i.e., a hole for the detent and spring) to be molded into the receiver body 101 or a hole may be drilled into a portion of the receiver body 101 after the molding process.

Figure 7A:
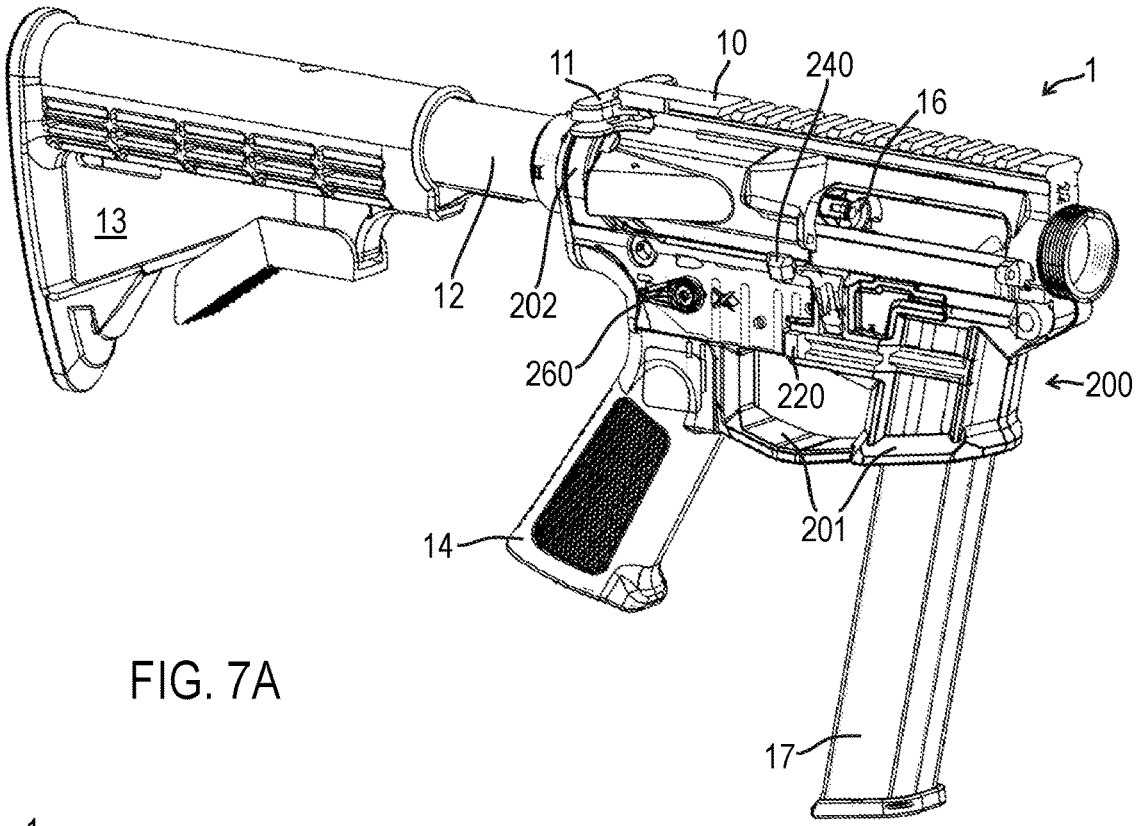
FIG. 7A is a front right perspective view of a firearm according to certain embodiments of the present invention.
Figure 7B:
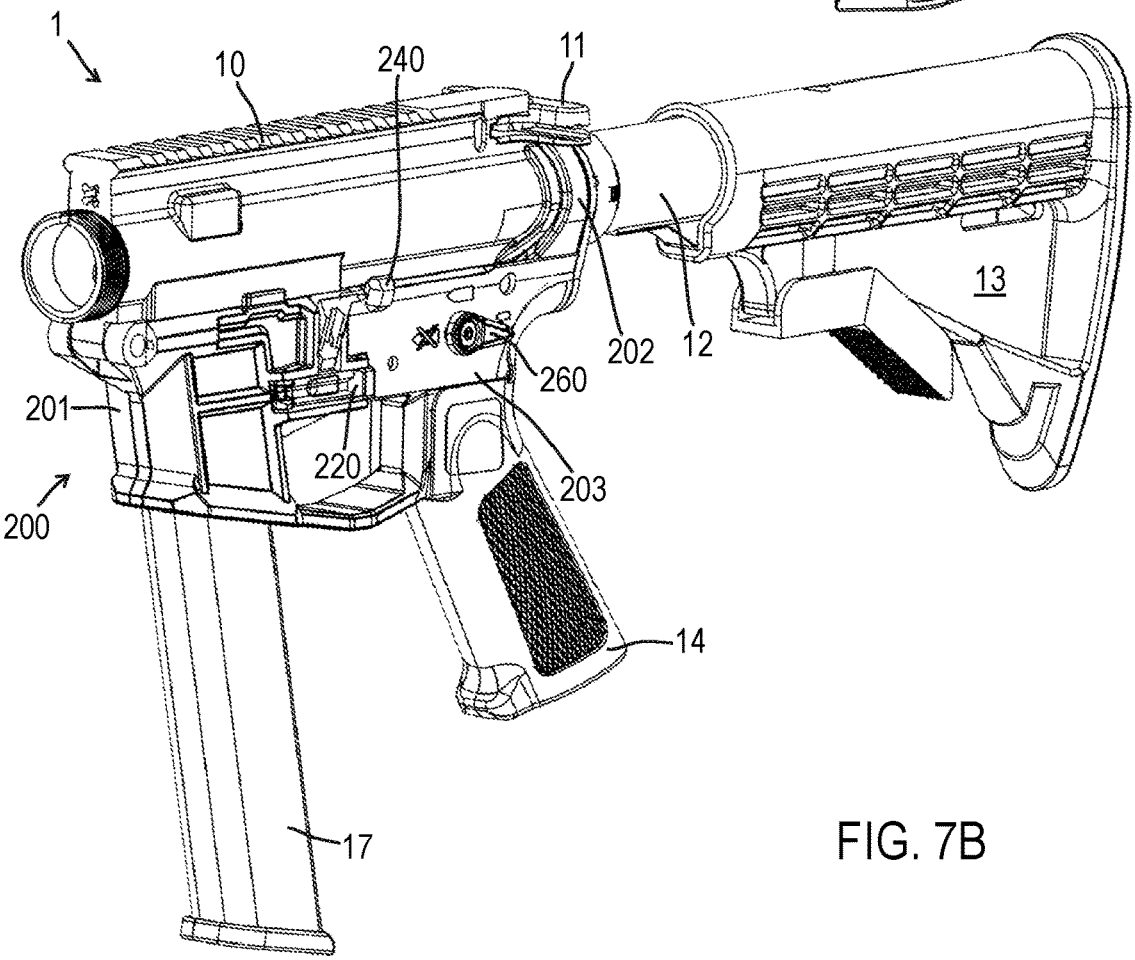
FIG. 7B is a front left perspective view of the firearm of FIG. 7A.

As shown in FIGS. 7A and 7B, in some cases, a firearm 1 includes a receiver assembly 200, an upper receiver 10, a charging handle 11, a buffer tube 12, a stock 13, a grip 14, a magazine 17, and a bolt carrier group 16. Other components, including, for example, a barrel, a fire control group, and a handguard, are not illustrated for simplicity.

Figure 8A:
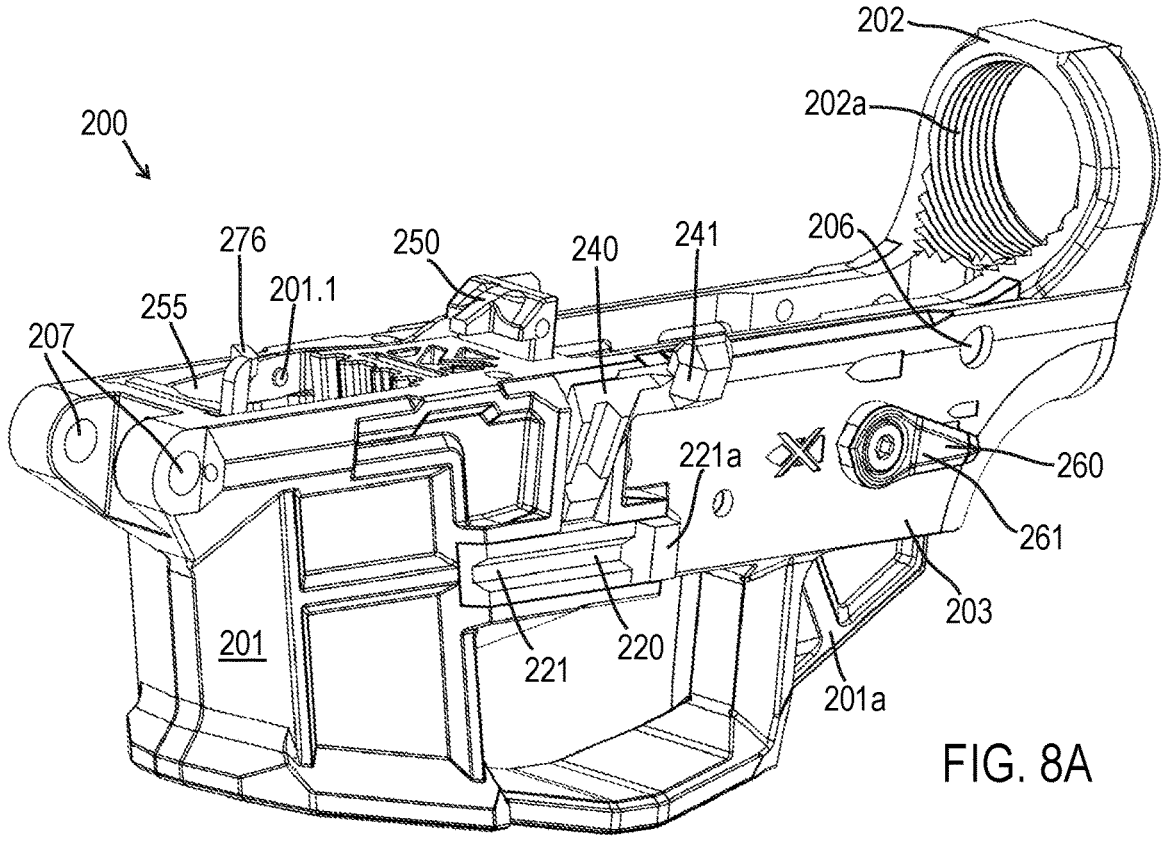
FIG. 8A is a front left perspective view of a receiver assembly of the firearm of FIG. 7A.

According to certain embodiments of the present invention, the receiver assembly 200 may include a magazine release assembly 220, a bolt release assembly 240, and a safety selector assembly 260. As shown in FIG. 8A, the receiver assembly 200 may also include a receiver body 201, a threaded mount 202, and a magazine well 205. In some embodiments, the receiver assembly 200 interfaces with the upper receiver 10 with two pinned connections including an interface at a takedown pin hole 206 and at a pivot pin hole 207. The takedown pin hole 206 may extend through both the receiver body 201 and the threaded mount 202. The magazine 17 may be capable of being inserted into the magazine well 205 (see FIGS. 7A-8B). In some embodiments, the magazine 17 is a commercially available magazine designed for handguns (e.g., pistol calibers including, for example, 9×19 mm, .45 ACP, .40 S&W, .380 ACP, 10 mm Auto, 5.7×28 mm, .22 Long Rifle, etc.) or any other appropriate magazine. The magazine 17 may be a standard magazine designed for rifle caliber (e.g., 5.56×45 mm NATO and/or .223 Remington, 7.62×35 mm or .300 AAC Blackout, 7.62×51 mm NATO and/or .308 Winchester ammunition, etc. The grip 14 may attach to a grip interface portion 201*a* of the receiver body 201. In some embodiments, the grip 14 may be an integral component of the receiver body 201.

The threaded mount 202 may be an integral portion of the receiver body 201 (typical for metallic lower receivers) or may be a separate component (e.g., see exploded view in FIG. 3). In some embodiments, the threaded mount 202 and the receiver body 201 are different materials. For example, the threaded mount 202 may be a metallic material and the receiver body 201 may be a non-metallic material, such as a polymer material, a plastic material, a composite material, or any appropriate non-metallic material. In some situations, the stress induced at the threaded connection 202*a* of the threaded mount 202 (i.e., cantilevered attachment of the buffer tube 12) is appropriate for a metallic component. Where the threaded mount 202 and the receiver body 201 are different materials, the receiver body 201 may be molded onto or around the threaded mount 202. For example, the receiver body 201 may be co-molded or injection molded relative to the threaded mount 202. One or both of the takedown pin hole 206 and the safety selector hole 219*a* may be used to locate the threaded mount 202 for the tooling (e.g., an injection molding machine). The threaded mount 202 may include a plurality of retaining features such that the material of the receiver body 201 can flow into or otherwise engage the retaining features to ensure sufficient engagement between the threaded mount 202 and the receiver body 201 (see, e.g., retaining features 104 in FIG. 3). The threaded mount 202 may also include a serial number plate 203 that protrudes through the receiver body 201 such that the serial number plate 203 is continuous with the outer surface of the receiver body 201 (see FIGS. 7B and 8A).

For embodiments that include polymer materials for some portion(s) of the receiver assembly 200, the polymer material may improve some characteristics of the firearm 1. For example, compared to some metallic materials (such as aluminum), the polymer material may absorb and dissipate more energy and/or vibration. This results in less energy transferred from the chamber of the firearm (where the cartridge is fired) to the operator (i.e., less recoil). Consequently, after firing a round, the operator can more quickly acquire subsequent targets, which results in greater accuracy for additional shots fired. In other words, some of the energy from firing the cartridge is absorbed in receiver body 201 without being transferred to the operator (where conventional metallic receivers will transfer a greater percentage of the energy to the operator).

Figure 9:
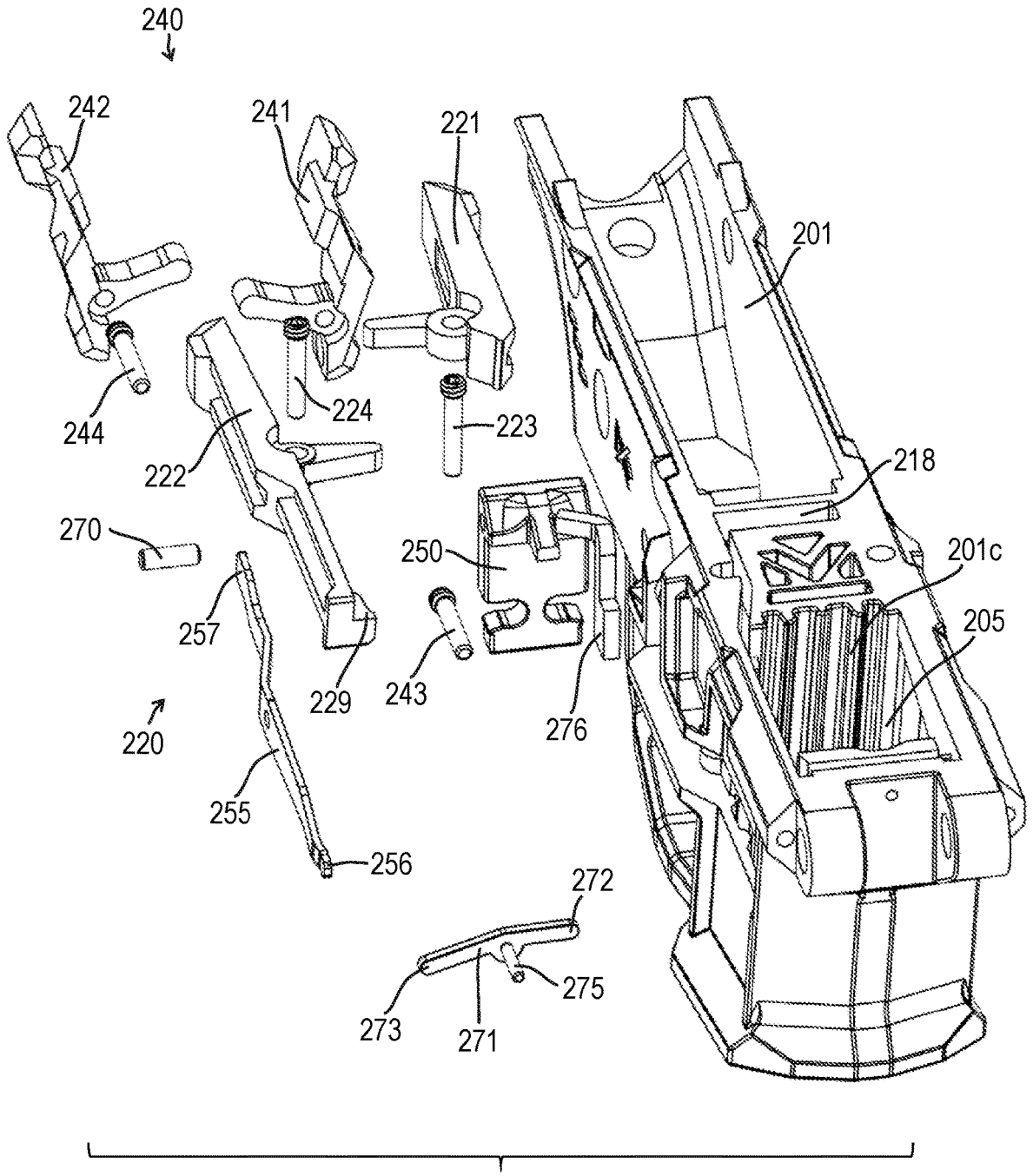
FIG. 9 is an exploded perspective view of the receiver assembly of FIG. 8A.
Figure 10A:
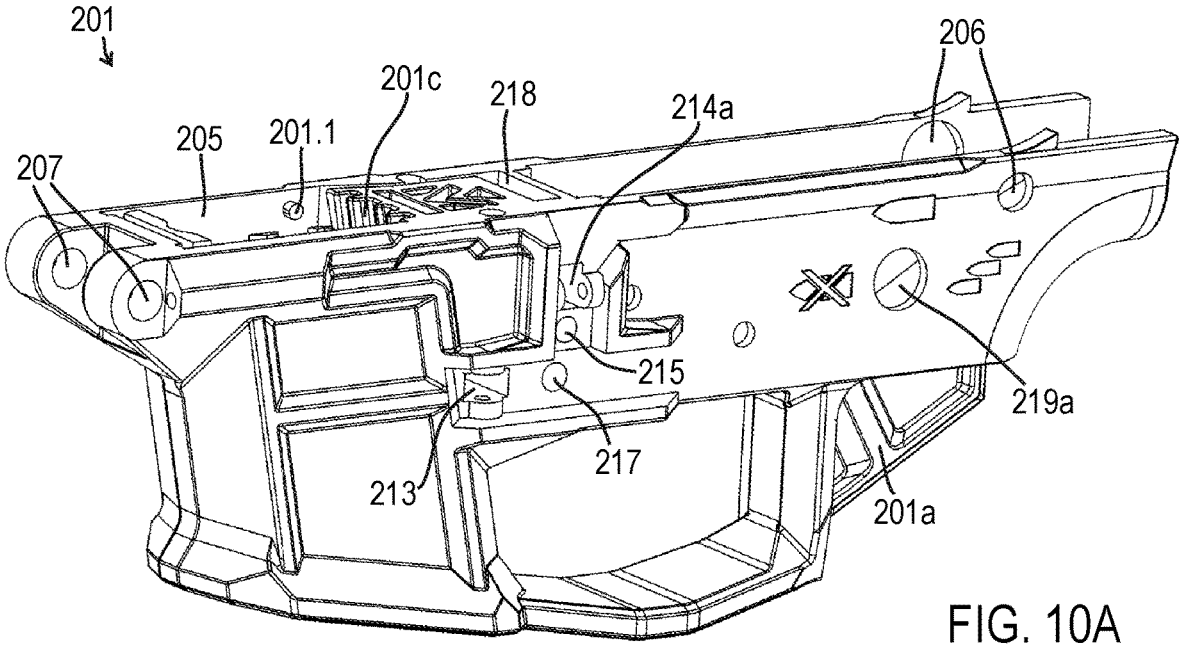
FIG. 10A is a front left perspective view of a receiver body of the receiver assembly of FIG. 8A.
Figure 10B:
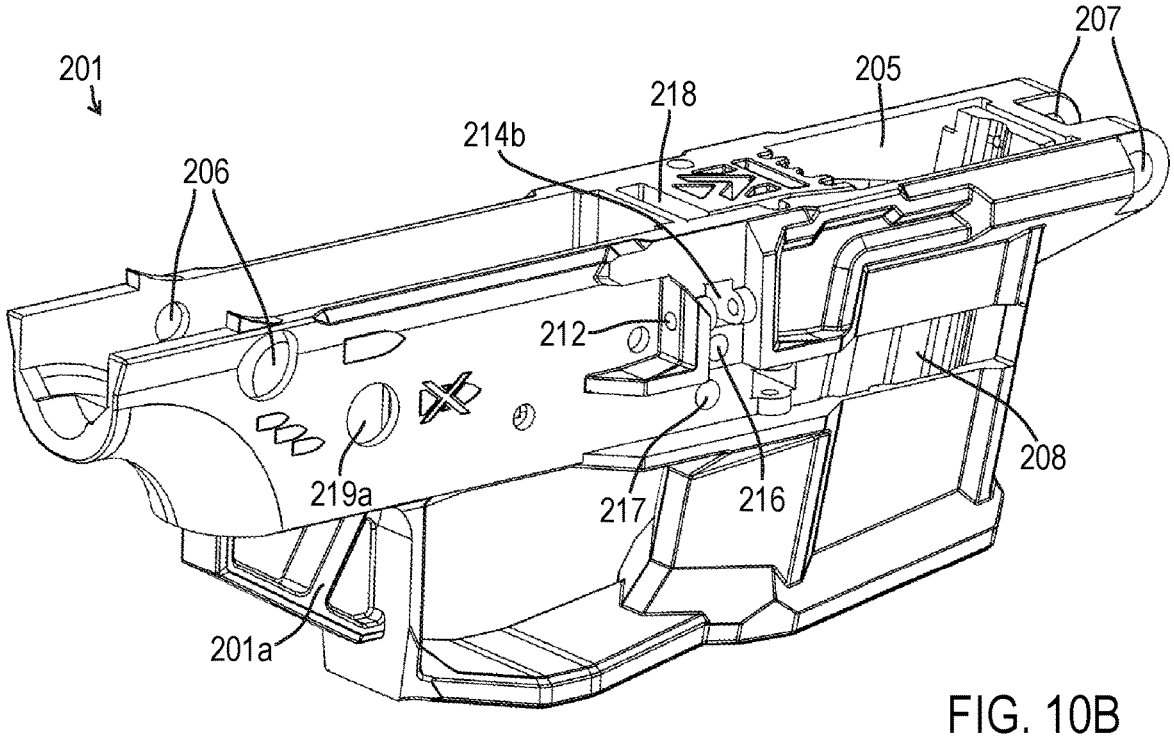
FIG. 10B is a rear right perspective view of the receiver body of FIG. 10A.

As shown in FIG. 9, in some embodiments, the receiver body 201 includes at least one rib 201*c* (and/or channel). The rib(s) 201*c* may be located in the magazine well 205. In some cases, the rib(s) 201*c* help expel dirt and foreign objects from the magazine well 205, lighten the receiver body 201, reduce thickness in the relevant areas of the receiver body 201, reduce manufacturing cycle time for the receiver body 201, and/or more improve efficient heat transfer of the receiver body 201.

In some embodiments, the magazine release assembly 220 includes at least one mechanism for releasing the magazine 17 from the magazine well 205. In particular, the magazine may be released due to movement of the left and/or right side magazine release portions 221, 222. Conventional lower receivers include a button-operated mechanism that releases a magazine based on linear movement where the mechanism can only be operated from the right side of the firearm (designed exclusively for right-handed operators). While the magazine release assembly 220 may include a single mechanism on only one side of the firearm, in some embodiments, the magazine release assembly 220 includes a left side magazine release portion 221 and a right side magazine release portion 222 such that the magazine release assembly 220 is fully ambidextrous (see FIGS. 8A, 8B, 11A, and 11B). In some embodiments, the left and/or right side magazine release portions 221, 222 may each include a lever mechanism (as described below with vertical pins 223, 224) while in other embodiments, the magazine release assembly 220 includes other modes of operation including, for example, electronic, gear-driven, belt-driven, linear actuators, other mechanical systems, or any other appropriate type of operation. In other words, the magazine release assembly 220 may include at least one pivoting lever.

Figure 11A:
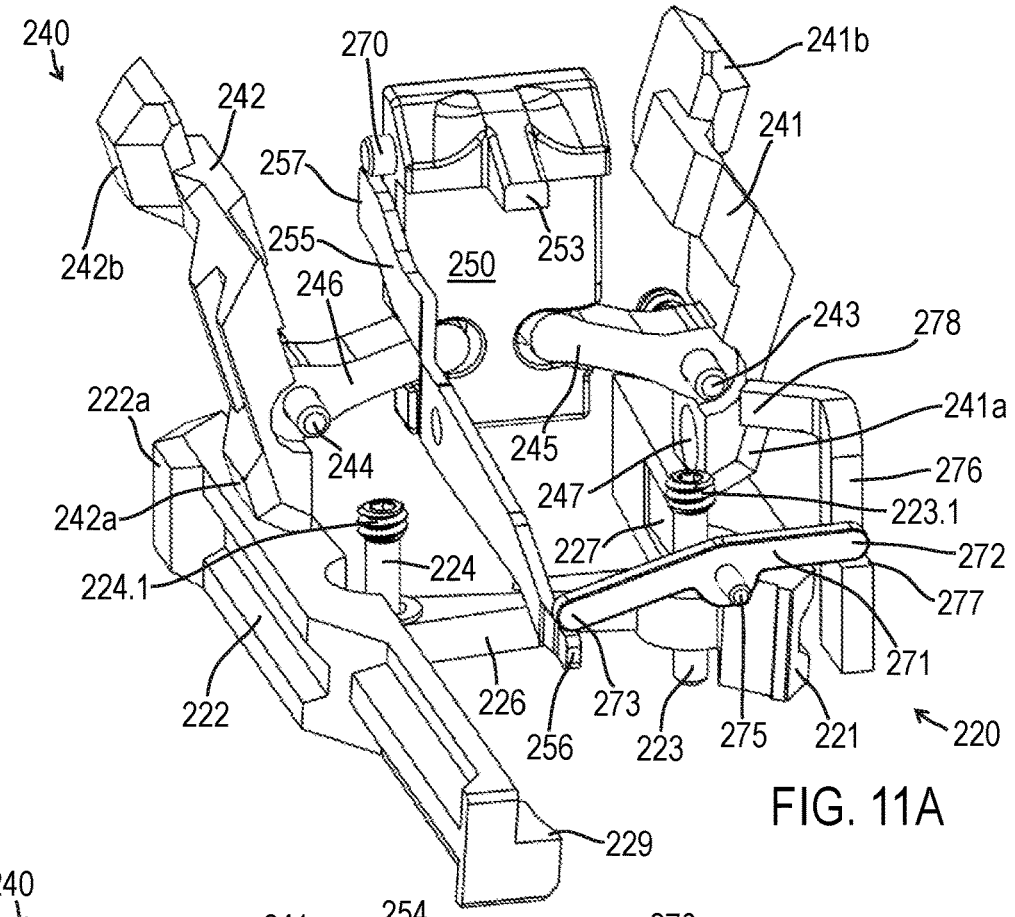
FIG. 11A is a front right perspective view of a magazine release assembly and a bolt release assembly of the firearm of FIG. 7A.
Figure 11B:
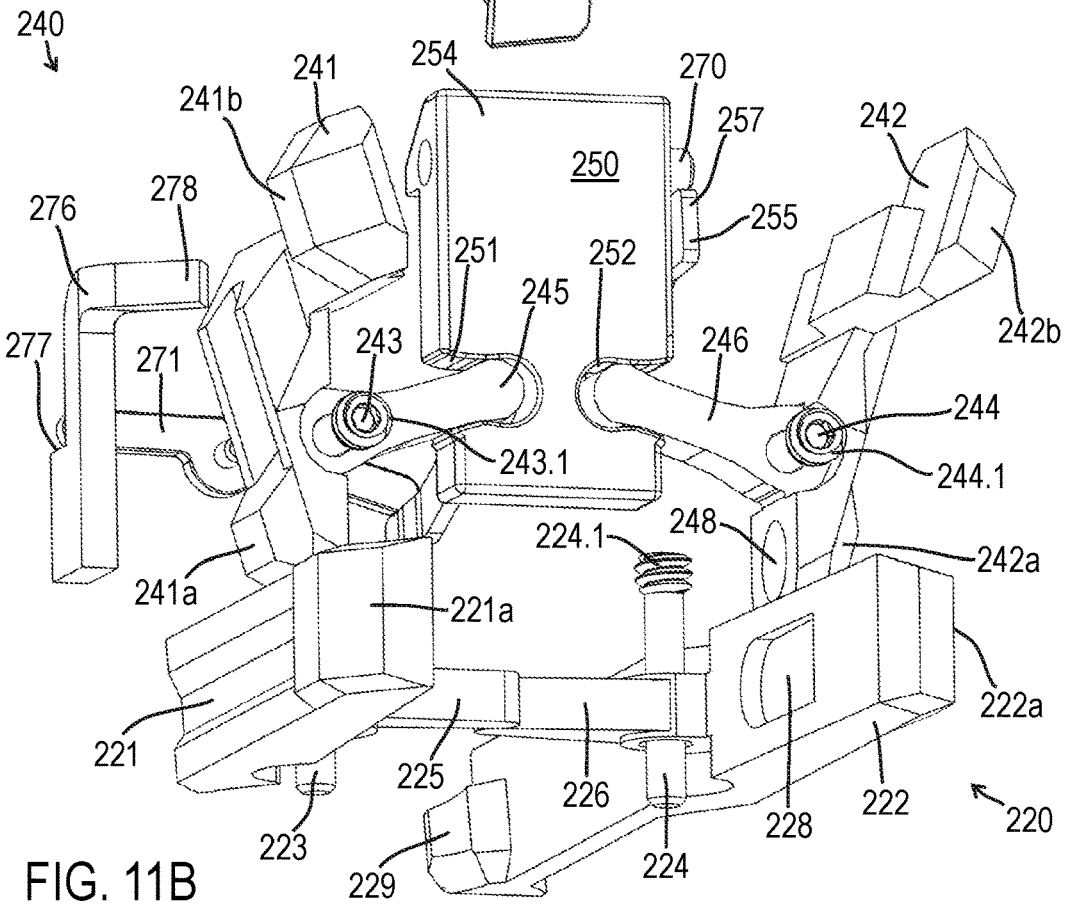
FIG. 11B is a rear left perspective view of the magazine release assembly and the bolt release assembly of FIG. 11A.

As shown in FIG. 8A, the left side magazine release portion 221 may include a rear portion 221*a* closer to the firearm trigger such that the rear portion 221*a* is designed to interface with the operator's left index finger (i.e., the left side magazine release portion 221 is designed for left-handed operators). The left side magazine release portion 221 does not extend as far forward as the right side magazine release portion 222 because the relevant feature (i.e., the locking recess of the magazine 17) may be located on the right side. As shown in FIGS. 11A-11B, the left side magazine release portion 221 may include an arm 225 such that the left side magazine release portion 221 is designed to pivot about a vertical axis defined by left side vertical pin 223. The arm 225 may be inserted into passage 213 (see FIG. 13A) and the pin 223 is engaged in a retaining feature 209 that is located above, below, or both above and below the passage 213. In some embodiments, the retaining feature 209 is a hole extending down from an upper surface of the receiver body 201 (see FIGS. 13A-13B) and the vertical pin 223 is a set screw that may include threads 223.1. In some cases, the threads 223.1 are disposed at the upper end of the pin 223, and the threads 223.1 engage the hole 209. In other embodiments, the retaining feature 209 is designed to provide a "snap-fit" such that the left side magazine release portion 221 and pin 223 can be pressed into position (and/or removed) relative to the receiver body 201 without any specialty tools. In some cases, to bias the left side magazine release portion 221 toward engagement with the magazine 17, the magazine release assembly 220 includes a spring within hole 217 such that the spring interfaces with recess 227 of the left side magazine release portion 221 (see FIG. 11A). The left side magazine release portion 221 is biased in the clockwise direction when viewed from above (by the spring in hole 217) such that pressure on the rear portion 221*a* of the left side magazine release portion 221 (e.g., from the operator's left index finger) will cause the left side magazine release portion 221 to rotate in the counter-clockwise direction when viewed from above (against spring pressure). Rotation of the left side magazine release portion 221 also causes the arm 225 to rotate within the passage 213. Rotation of the left side magazine release portion 221 causes the arm 225 to rotate within the passage 213 such that the arm 225 presses against arm 226 causing the right side magazine release portion 222 to rotate in the clockwise direction (when viewed from above) thus causing the protrusion 229 to disengage from the corresponding feature of the magazine 17. In other words, in some cases, movement of the left side magazine release portion 221 causes movement of the right side magazine release portion 222, which results in the disengagement of the protrusion 229 from the magazine 17 (when a magazine is present). In some cases, there is a ball-nosed plunger at the end of the spring (in hole 217) for interfacing with the recess 227. The spring and the ball-nosed plunger are not illustrated for simplicity. In some embodiments, the hole 217 is a through hole that extends through a full width of the receiver body 201; however, in other embodiments, each side of the receiver body 201 includes a separate hole that may or may not align with one another (i.e., there is a separate hole for the left side magazine release portion 221 and the right side magazine release portion 222).

Figure 8B:
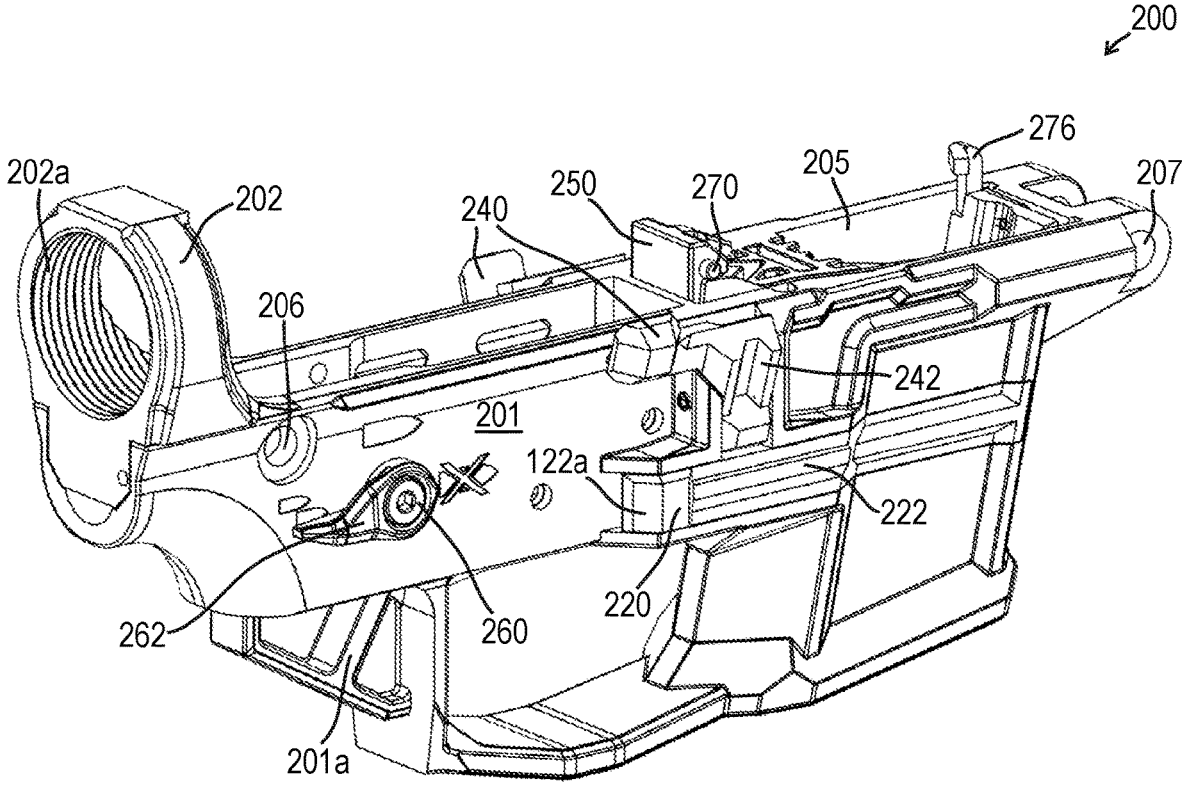
FIG. 8B is a rear right perspective view of the receiver assembly of FIG. 8A.

As shown in FIG. 8B, the right side magazine release portion 222 includes a rear portion 222*a* adjacent to the firearm trigger such that the rear portion 222*a* is designed to interface with the operator's right index finger (i.e., the right side magazine release portion 222 is designed for right-handed operators). The forward end of the right side magazine release portion 222 includes a protrusion 229 that extends through hole 208 of the receiver body 201 and engages a corresponding locking recess of the magazine 17 (see FIGS. 8B and 10B-11B). The protrusion 229 may be compatible with conventional magazines and/or various commercially available magazines including, for example, pistol magazines designed for a pistol caliber (e.g., pistol calibers including, for example, 9×19 mm, .45 ACP, .40 S&W, .380 ACP, 10 mm Auto, 5.7×28 mm, .22 Long Rifle, etc.). As shown in FIGS. 8B and 10B-11B, the right side magazine release portion 222 may include an arm 226 such that the right side magazine release portion 222 is designed to pivot about a vertical axis defined by right side vertical pin 224. The arm 226 may be inserted into passage 213 (see FIG. 13B) and the pin 224 is engaged in a retaining feature 210 that is located above, below, or both above and below the passage 213. In some embodiments, the retaining feature 210 is a hole extending down from an upper surface of the receiver body 201 (see FIGS. 13A-13B) and the vertical pin 224 is a set screw that may include threads 224.1. In some cases, the threads 224.1 are disposed at the upper end of the pin 224, and the threads 224.1 engage the hole 210. In other embodiments, the retaining feature 210 is designed to provide a "snap-fit" such that the right side magazine release portion 222 and pin 224 can be pressed into position (and/or removed) relative to the receiver body 201 without any specialty tools. In some cases, to bias the right side magazine release portion 222, the magazine release assembly 220 includes a spring within hole 217 such that the spring interfaces with recess 228 of the right side magazine release portion 222 (see FIG. 11B). The right side magazine release portion 222 is biased in the counter-clockwise direction when viewed from above (by the spring in hole 217) such that protrusion 229 is biased toward engagement with the magazine and pressure on the rear portion 222*a* of the right side magazine release portion 222 (e.g., from the operator's right index finger) will cause the right side magazine release portion 222 to rotate in the clockwise direction when viewed from above to disengage the protrusion 229 from the corresponding feature of the magazine 17 (against spring pressure). Rotation of the right side magazine release portion 222 causes the arm 226 to rotate within the passage 213 such that the arm 226 presses against arm 225 causing the left side magazine release portion 221 to rotate in the counter-clockwise direction. In other words, in some cases, movement of the right side magazine release portion 222 causes movement of the left side magazine release portion 221. In some cases, there is a ball-nosed plunger at the end of the spring (in hole 217) for interfacing with the recess 228. The spring and the ball-nosed plunger are not illustrated for simplicity. As described above, in some examples, the hole 217 is common to both the left side magazine release portion 221 and the right side magazine release portion 222, but this is not always the case.

In some cases, the operator interface portions (rear portion 221*a* and rear portion 222*a*) are symmetric on each side of the receiver assembly 200. Such a configuration ensures consistent operation and ergonomics for each operator, including both right-hand dominant and left-hand dominant operators.

Figure 12A:
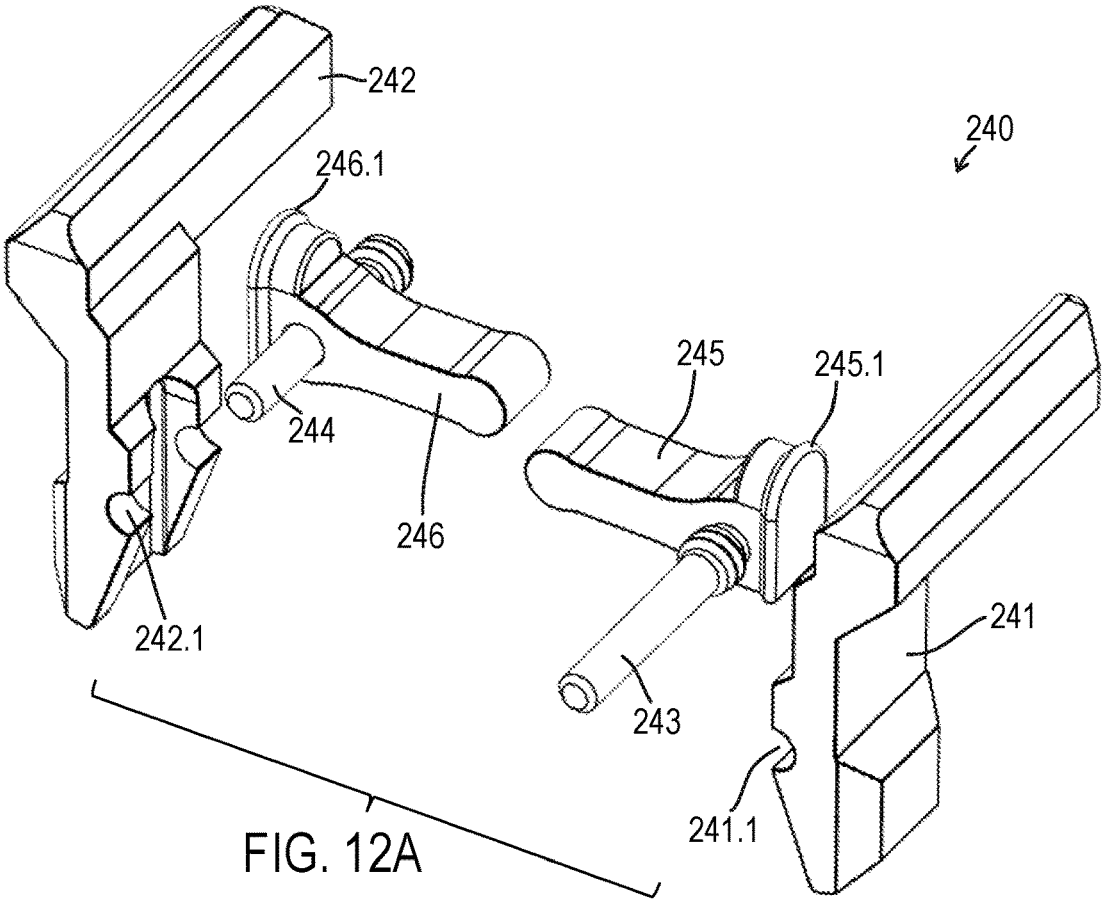
FIG. 12A is a perspective exploded view of a bolt release assembly of the firearm of FIG. 7A.
Figure 12B:
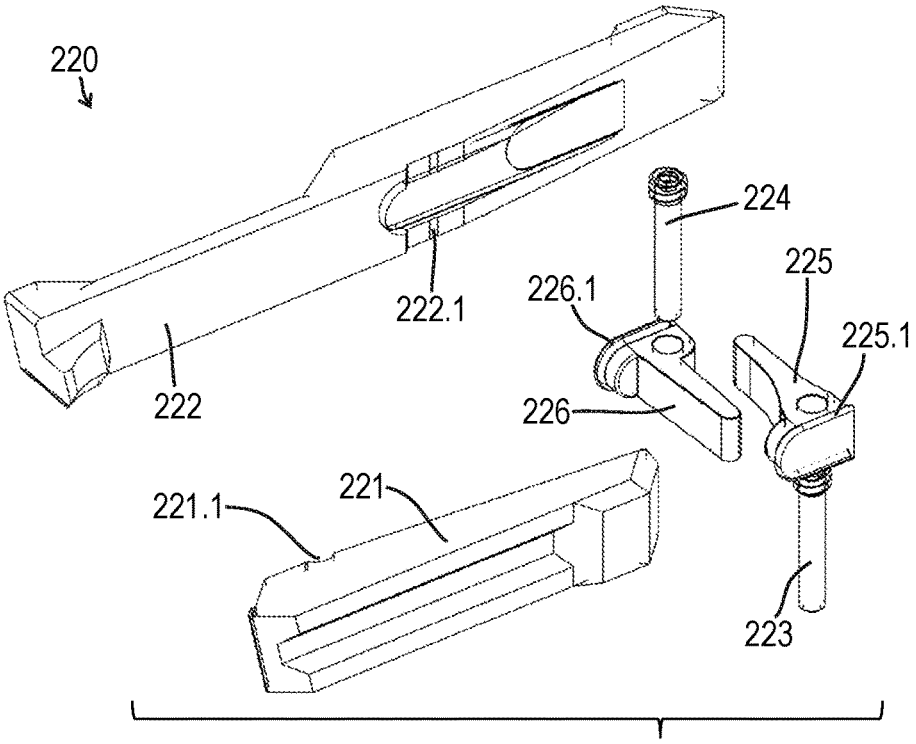
FIG. 12B is a perspective exploded view of a magazine release assembly of the firearm of FIG. 7A.
Figure 13A:
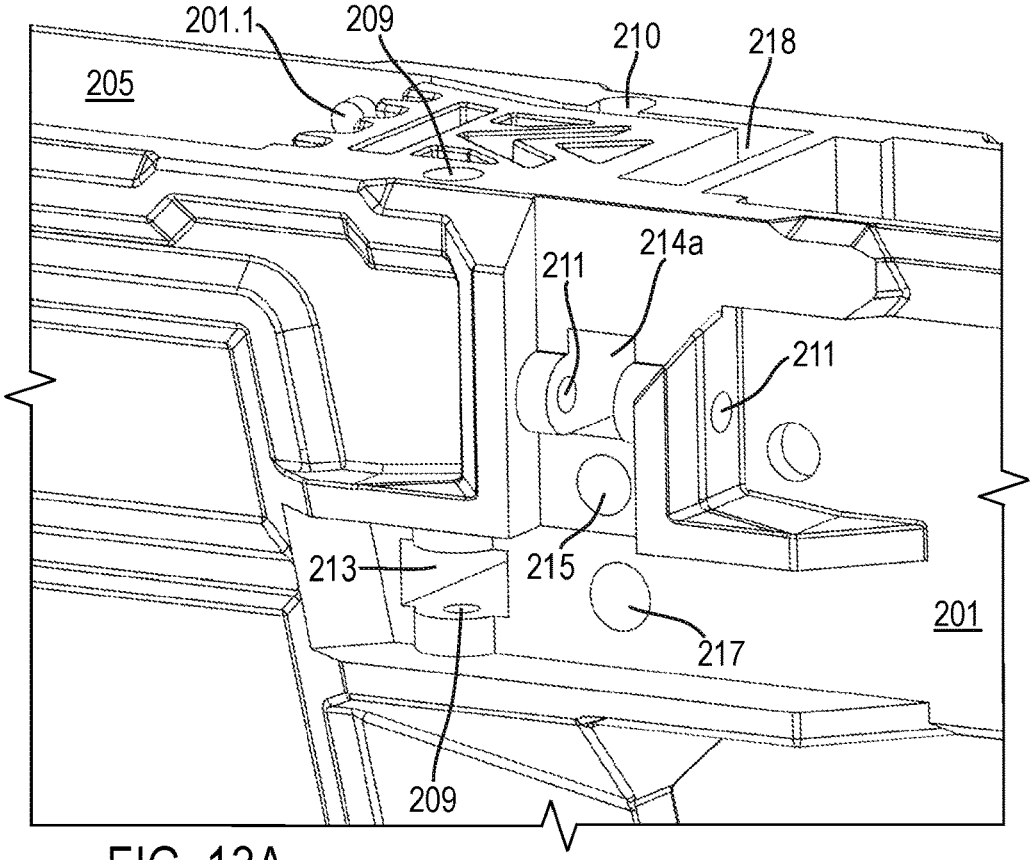
FIG. 13A is a partial perspective view of the left side of a receiver body of the firearm of FIG. 7A.
Figure 13B:
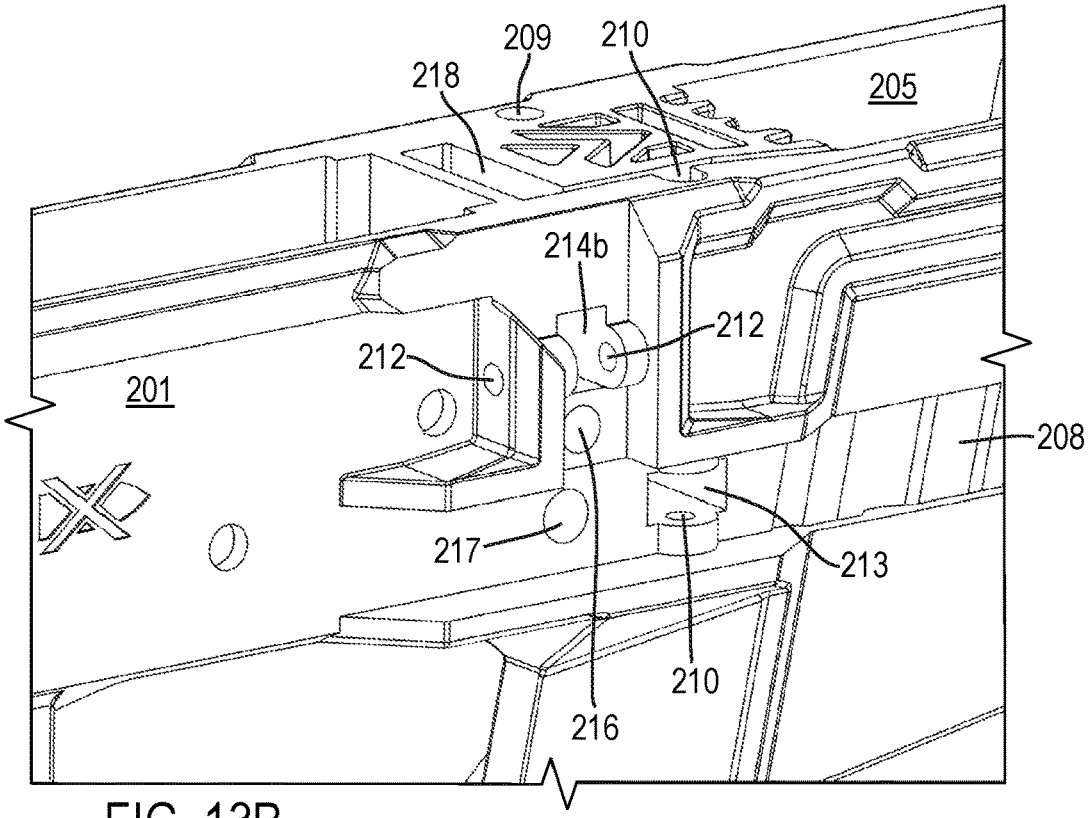
FIG. 13B is a partial perspective view of the right side of the receiver body of FIG. 13A.
Figure 14:
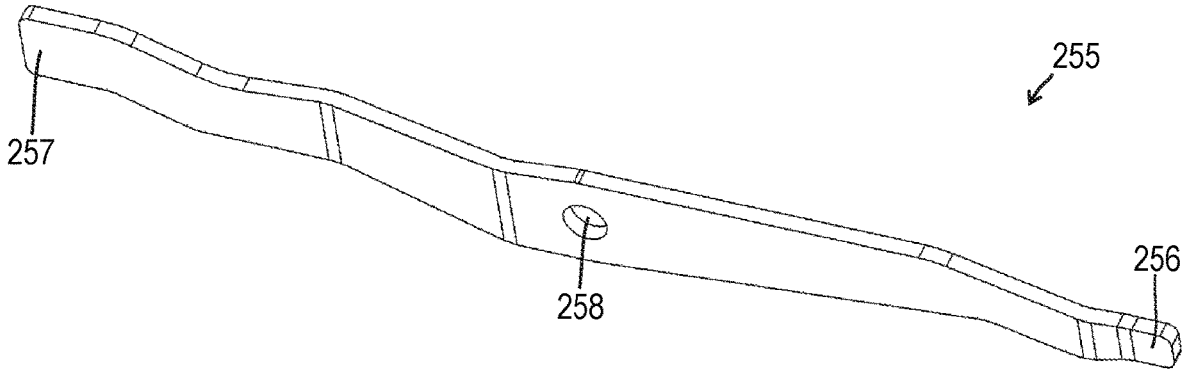
FIG. 14 is a perspective view of a long rocker of the firearm of FIG. 7A.

As shown in FIGS. 11A and 11B, in some embodiments, left and/or right side magazine release portions 221, 222 may each be a single unitary component (including the relevant arm 225, 226). In other embodiments, as shown in FIG. 12B, the magazine release assembly 220 may be arranged such that the left side magazine release portion 221 is a separate component from the arm 225 and the right side magazine release portion 222 is a separate component from the arm 226. In some embodiments, the arm 225 includes a feature (e.g., feature 225.1) for engaging the left side magazine release portion 221 and/or the arm 226 includes a feature (e.g., feature 226.1) for engaging the right side magazine release portion 222. In some embodiments, the features 225.1, 226.1 include a dovetail that engages a corresponding feature in the magazine release portion 221, 222. In addition to a corresponding features for engaging feature 226.1, the right side magazine release portion 222 may include a hole 222.1 such that insertion of the pin 224 secures the right side magazine release portion 222 relative to the arm 226. In other words, insertion of the pin 224 dictates that the right side magazine release portion 222 cannot be disengaged from the arm 226. The right side magazine release portion 222 may include a hole such that a set screw can be threaded through and at least partially into the arm 226 to secure the components together (either in addition to or in lieu of the engagement at hole 222.1). The left side magazine release portion 221 may include a similar hole 221.1 such that insertion of the pin 223 dictates that the left side magazine release portion 221 cannot be disengaged from the arm 225. The left side magazine release portion 221 may include a hole such that a set screw can be threaded through and at least partially into the arm 225 to secure the components together (either in addition to or in lieu of the engagement at hole 221.1). In some embodiments, separation of the magazine release portions 221, 222 from the arms 225, 226 allows an operator to swap the external interfacing components (e.g., to change the color, texture, shape, size, and/or other characteristics of the left and/or right side magazine release portions 221, 222).

The left and/or right side magazine release portions 221, 222 may be metallic components in some embodiments. In addition, the left and right side vertical pins 223, 224 may be metallic. In other embodiments, at least some portions of the left and right side magazine release portions 221, 222 (and/or the left and right side vertical pins 223, 224) may be a non-metallic material (e.g., polymer).

Figure 15A:
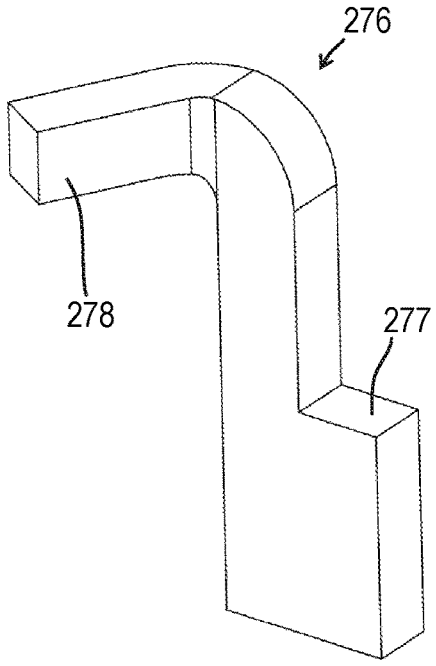
FIGS. 15A and 15B are perspective views of a lifter of the firearm of FIG. 7A.
Figure 15B:
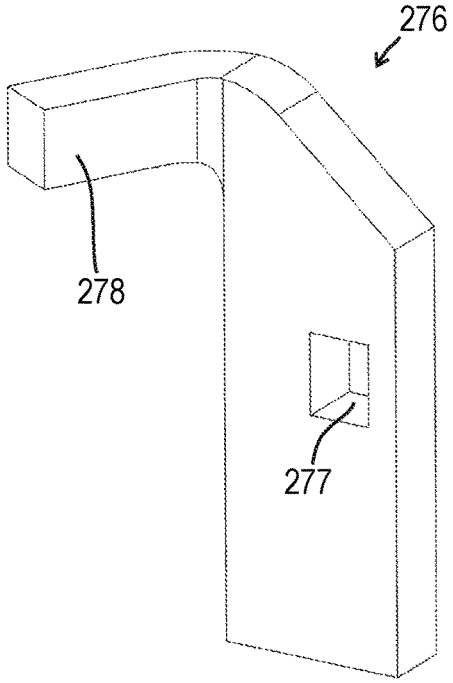

In some embodiments, the bolt release assembly 240 includes at least one mechanism for manipulating the bolt carrier group 16. In some cases, the bolt carrier group 16 is biased toward a forward end of the firearm (e.g., by a spring within the buffer tube 12). In certain conditions, the bolt release assembly 240 engages and holds the bolt carrier group 16 in a rear position (see FIG. 7A) where the rear surface 254 of the bolt release central portion 250 engages the forward face of the bolt carrier group 16. The bolt release central portion 250 is at least partially located within the cavity 218 of the receiver body 201, and the bolt release central portion 250 can be raised upward due to upward movement of the follower of the magazine 17. In some embodiments, a lifter 276 interfaces with the follower of the magazine 17 such that, when the magazine 17 is empty, the follower pushes upper end 278 upward (see FIGS. 8A-9, 11A, 15A, and 15B). Upward movement of the lifter 276 causes portion 277 to interface with rocker 271 such that first end 272 is lifted upward by portion 277. As shown in FIG. 15A, the portion 277 may be a step in some embodiments. In other embodiments, the portion 277 is an opening or aperture, as shown in FIG. 15B. Upward movement of first end 272 causes rocker 271 to rotate about pin 275. The rotation of rocker 271 causes second end 273 to move downward. Downward movement of the second end 273 of the rocker 271 leads to an interface between the second end 273 and a forward end 256 of the long rocker 255 (which causes downward movement of the forward end 256). The long rocker 255 is shown in FIGS. 8A, 9, 11A, 11B, and 14. Downward movement of the forward end 256 of the long rocker 255 causes the long rocker 255 to rotate about hole 258. In some embodiments, the hole 258 engages protrusion 201.1 of the receiver body 201 (see FIGS. 8A, 10A, and 13A). The rotation of long rocker 255 about hole 258 (caused by downward motion of the second end 273 and the interface with forward end 256) causes the rear end 257 to move upward. Upward movement of the rear end 257 of the long rocker 255 leads to an interface between the rear end 257 and a bolt release pin 270 such that the bolt release pin 270 is moved upward. The upward movement of the bolt release pin 270 causes the bolt release central portion 250 to move upward to engage the bolt carrier group 16 (in the rear position). In other words, movement of the follower of the magazine 17 and/or movement of the left and/or right side bolt release portions 241, 242 (as described below) can cause the bolt release central portion 250 to hold the bolt carrier group 16 in the rear position. In some embodiments, the bolt release central portion 250 translates or moves linearly (i.e., does not rotate).

Conventional lower receivers include a pivoting mechanism that manipulates a bolt carrier group based on rotational movement where the mechanism can only be operated from the left side of the firearm. While the bolt release assembly 240 may include a single mechanism on only one side of the firearm, in some embodiments, the bolt release assembly 240 includes a left side bolt release portion 241 and a right side bolt release portion 242 such that the bolt release assembly 240 is fully ambidextrous. In some embodiments, the left and/or right side bolt release portions 241, 242 may each include a lever mechanism (as described below with pins 243, 244) while in other embodiments, the bolt release assembly 240 includes other modes of operation including, for example, electronic, gear-driven, belt-driven, linear actuators, other mechanical systems, or any other appropriate type of operation. In other words, the bolt release assembly 240 may include at least one pivoting lever.

As shown in FIGS. 11A and 11B, the left side bolt release portion 241 includes a lower portion 241*a* and an upper portion 241*b* (designed for an operator to manipulate the left side bolt release portion 241) along with an arm 245 and is designed to pivot about a forward/aft axis defined by left side pin 243. In some embodiments, the arm 245 may be inserted into passage 214*a* (see FIG. 13A) which intersects cavity 218, and the pin 243 is engaged in a retaining feature 211 that is located forward, aft, or both forward and aft of the passage 214*a*. The arm 245 may engage a first cutout 251 of the bolt release central portion 250. In some embodiments, the retaining feature 211 is a hole extending fore/aft in the receiver body 201 (see FIG. 13A) and the pin 243 is a set screw that may include threads 243.1. In some cases, the threads 243.1 are disposed at the rear end of the pin 243, and the threads 243.1 engage the hole 211. In other embodiments, the retaining feature 211 is designed to provide a "snap-fit"such that the left side bolt release portion 241 and pin 243 can be pressed into position (and/or removed) relative to the receiver body 201 without any specialty tools. Pressing the lower portion 241*a* causes the left side bolt release portion 241 to rotate about the left side pin 243 such that the arm 245 pivots and causes the bolt release central portion 250 to move upward (i.e., toward a position where the bolt release central portion 250 would engage the bolt carrier group 16). Similarly, pressing the upper portion 241*b* causes the left side bolt release portion 241 to rotate about the left side pin 243 such that the arm 245 pivots and causes the bolt release central portion 250 to move downward (i.e., away from a position where the bolt release central portion 250 would engage the bolt carrier group 16). In some cases, the bolt release assembly 240 includes a spring within hole 215 such that the spring interfaces with recess 247 of the left side bolt release portion 241 (see FIG. 11A) to bias the bolt release central portion 250 downward such that the bolt carrier group 16 can move past the bolt release assembly 240. In some embodiments, the bolt release central portion 250 translates or moves linearly (i.e., does not rotate).

Although the pin 243 is illustrated as a separate component from the left side bolt release portion 241, in some cases, the pin 243 is an integral component of the left side bolt release portion 241. In such a configuration, the left side bolt release portion 241 can be directly attached and/or detached from the retaining feature 211 without any intervening component.

As shown in FIGS. 11A and 11B, the right side bolt release portion 242 includes a lower portion 242*a* and an upper portion 242*b* (designed for an operator to manipulate the right side bolt release portion 242) along with an arm 246 and is designed to pivot about a forward/aft axis defined by right side pin 244. In some embodiments, the arm 246 may be inserted into passage 241*b* (see FIG. 13B) which intersects cavity 218, and the pin 244 is engaged in a retaining feature 212 that is located forward, aft, or both forward and aft of the passage 214*b*. The arm 246 engages a second cutout 252 of the bolt release central portion 250. In some embodiments, the retaining feature 212 is a hole extending fore/aft in the receiver body 201 (see FIG. 13B) and the pin 244 is a set screw that may include threads 244.1. In some cases, the threads 244.1 are disposed at the rear end of the pin 244, and the threads 244.1 engage the hole 212. In other embodiments, the retaining feature 212 is designed to provide a "snap-fit"such that the right side bolt release portion 242 and pin 244 can be pressed into position (and/or removed) relative to the receiver body 201 without any specialty tools. Pressing the lower portion 242*a* causes the right side bolt release portion 242 to rotate about the right side pin 244 such that the arm 246 pivots and causes the bolt release central portion 250 to move upward (i.e., toward a position where the bolt release central portion 250 would engage the bolt carrier group 16). Similarly, pressing the upper portion 242*b* causes the right side bolt release portion 242 to rotate about the left side pin 244 such that the arm 246 pivots and causes the bolt release central portion 250 to move downward (i.e., away from a position where the bolt release central portion 250 would engage the bolt carrier group 16). In some cases, the bolt release assembly 240 includes a spring within hole 216 such that the spring interfaces with recess 248 of the right side bolt release portion 242 (see FIG. 13B) to bias the bolt release central portion 250 downward such that the bolt carrier group 16 can move past the bolt release assembly 240. Accordingly, the bolt release assembly 240 may include two springs acting together to bias the bolt release central portion 250 downward (i.e., one spring interfacing with recess 247 of the left side bolt release portion 241 and a second spring interfacing with recess 248 of the right side bolt release portion 242).

Although the pin 244 is illustrated as a separate component from the right side bolt release portion 242, in some cases, the pin 244 is an integral component of the right side bolt release portion 242. In such a configuration, the right side bolt release portion 242 can be directly attached and/or detached from the retaining feature 212 without any intervening component.

Based on the movement of at least one of arms 245, 246 (as described above), and/or the follower of the magazine 17 pushing on lifter 276 (as described above), the bolt release central portion 250 moves approximately vertically within cavity 218. In other words, the bolt release central portion 250 translates approximately vertically (i.e., linearly) within cavity 218, while conventional bolt release mechanisms pivot (without translating).

In some cases, the operator interface portions for raising the bolt release central portion 250 (lower portion 241*a* and lower portion 242*a*) are symmetric on each side of the receiver assembly 200. Similarly, the operator interface portions for lowering the bolt release central portion 250 (upper portion 241*b* and upper portion 242*b*) may be symmetric on each side of the receiver assembly 200. Such a configuration ensures consistent operation and ergonomics for each operator, including both right-hand dominant and left-hand dominant operators.

As shown in FIGS. 9, 11A, and 11B, in some embodiments, left and/or right side bolt release portions 241, 242 may each be a single unitary component (including the relevant arm 245, 246). In other embodiments, as shown in FIG. 12A, the bolt release assembly 240 may be arranged such that the left side bolt release portion 241 is a separate component from the arm 245 and the right side bolt release portion 242 is a separate component from the arm 246. In some embodiments, the arm 245 includes a feature (e.g., feature 245.1) for engaging the left side bolt release portion 241 and/or the arm 246 includes a feature (e.g., feature 246.1) for engaging the right side bolt release portion 242. In some embodiments, the features 245.1, 246.1 include a dovetail that engages a corresponding feature in the bolt release portion 241, 242. In addition to a corresponding features for engaging feature 246.1, the right side bolt release portion 242 may include a hole 242.1 such that insertion of the pin 244 secures the right side bolt release portion 242 relative to the arm 246. In other words, insertion of the pin 244 dictates that the right side bolt release portion 242 cannot be disengaged from the arm 246. The right side bolt release portion 242 may include a hole such that a set screw can be threaded through and at least partially into the arm 246 to secure the components together (either in addition to or in lieu of the engagement at hole 242.1). The left side bolt release portion 241 may include a similar hole 241.1 such that insertion of the pin 243 dictates that the left side bolt release portion 241 cannot be disengaged from the arm 245. The left side bolt release portion 241 may include a hole such that a set screw can be threaded through and at least partially into the arm 245 to secure the components together (either in addition to or in lieu of the engagement at hole 241.1). In some embodiments, separation of the bolt release portions 241, 242 from the arms 245, 246 allows an operator to swap the external interfacing components (e.g., to change the color, texture, shape, size, and/or other characteristics of the left and/or right side bolt release portions 241, 242).

The left and/or right side bolt release portions 241, 242 may be metallic components in some embodiments. In addition, the left and right side pins 243, 244 may be metallic. In other embodiments, at least some portions of the left and right side bolt release portions 241, 242 (and/or the left and right side pins 243, 244) may be a non-metallic material (e.g., polymer).

As shown in FIGS. 7A-8B, the safety selector assembly 260 may interface with the safety selector hole 219*a*. The safety selector assembly 260 includes at least one safety portion, and, in some cases, includes a left side safety portion 261 and a right side safety portion 262 such that the safety selector assembly 260 is fully ambidextrous. Such a configuration ensures consistent operation and ergonomics for each operator, including both right-hand dominant and left-hand dominant operators.

The components of any of the firearms 1 and/or the receiver assemblies 100, 200 described herein may be formed of materials including, but not limited to, thermoplastic, carbon composite, plastic, nylon, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A firearm receiver assembly comprising:

a receiver body;

a threaded mount at a rear portion of the receiver body;

a magazine release assembly comprising a magazine release portion on at least one side of the receiver body;

a bolt release assembly comprising a bolt release portion on at least one side of the receiver body; and a safety selector assembly comprising a safety portion on at least one side of the receiver body, wherein the bolt release assembly comprises a central portion that translates in a single direction without rotating within a cavity of the receiver body such that the cavity is disposed within an integrally formed wall extending between a left side and a right side of the receiver body.

2. The firearm receiver assembly of claim 1, wherein the receiver body comprises a polymer material.

3. The firearm receiver assembly of claim 1, wherein:

the threaded mount is a separate component from the receiver body;

the receiver body comprises a polymer material; and the threaded mount comprises a metallic material.

4. The firearm receiver assembly of claim 1, wherein:

the magazine release portion comprises a first magazine release portion on the left side of the receiver body and a second magazine release portion on the right side of the receiver body;

an operator interface portion of the first magazine release portion and an operator interface portion of the second magazine release portion are symmetric relative to one another;

the first magazine release portion comprises a pivoting lever; and the second magazine release portion comprises a pivoting lever.

5. The firearm receiver assembly of claim 4, wherein at least one selected from the group of the first magazine release portion and the second magazine release portion comprises a pin defining a rotational axis.

6. The firearm receiver assembly of claim 5, wherein the pin comprises a set screw with threads.

7. The firearm receiver assembly of claim 1, wherein the central portion is a separate component from other parts of the bolt release assembly.

8. The firearm receiver assembly of claim 1, wherein the threaded mount comprises a plurality of retaining features that engage a material of the receiver body.

9. The firearm receiver assembly of claim 1, wherein the bolt release assembly comprises:

a first bolt release portion comprising a pivoting lever and at least one operator interface portion;

a second bolt release portion comprising a pivoting lever and at least one operator interface portion; and the at least one operator interface portion of the first bolt release portion and the at least one operator interface portion of the second bolt release portion are symmetric relative to one another.

10. The firearm receiver assembly of claim 1, wherein:

the magazine release portion comprises a first magazine release portion on the left side of the receiver body and a second magazine release portion on the right side of the receiver body;

the bolt release portion comprises a first bolt release portion on the left side of the receiver body and a second bolt release portion on the right side of the receiver body; and the safety portion comprises a first safety portion on the left side of the receiver body and a second safety portion on the right side of the receiver body.

11. A firearm receiver assembly comprising:

a receiver body comprising a left side and a right side;

a threaded mount at a rear portion of the receiver body;

a magazine release assembly comprising a first magazine release portion on the left side of the receiver body and a second magazine release portion on the right side of the receiver body; and a bolt release assembly comprising a first bolt release portion on the left side of the receiver body, and a second bolt release portion on the right side of the receiver body, wherein:

the first magazine release portion comprises a pivoting lever;

the second magazine release portion comprises a pivoting lever that operates in a symmetric manner with the first magazine release portion;

the first bolt release portion comprises a pivoting lever; and the second bolt release portion comprises a pivoting lever that operates in a symmetric manner with the first bolt release portion.

12. The firearm receiver assembly of claim 11, wherein the receiver body comprises a polymer material.

13. The firearm receiver assembly of claim 11, wherein:

the threaded mount is a separate component from the receiver body;

the receiver body comprises a polymer material; and the threaded mount comprises a metallic material.

14. The firearm receiver assembly of claim 11, wherein at least one selected from the group of the first magazine release portion and the second magazine release portion comprises a pin defining a rotational axis.

15. The firearm receiver assembly of claim 14, wherein the pin comprises a set screw with threads.

16. The firearm receiver assembly of claim 11, wherein the bolt release assembly comprises a bolt release central portion.

17. The firearm receiver assembly of claim 16, wherein the bolt release central portion is a separate component from other parts of the bolt release assembly.

18. The firearm receiver assembly of claim 16, wherein the first bolt release portion interfaces with a forward side of the bolt release central portion and the second bolt release portion interfaces with a rear side of the bolt release central portion.

19. The firearm receiver assembly of claim 11, wherein the threaded mount comprises a plurality of retaining features that engage a material of the receiver body.

20. The firearm receiver assembly of claim 11, wherein at least one selected from the group of the first magazine release portion, the second magazine release portion, the first bolt release portion, or the second bolt release portion comprise a removable external interfacing component that is separate from the internal mechanism for operation.

21. A firearm receiver assembly comprising:

a receiver body comprising a polymer material;

a threaded mount at a rear portion of the receiver body;

a magazine release assembly comprising a magazine release portion on at least one side of the receiver body;

a bolt release assembly comprising a bolt release portion on at least one side of the receiver body; and a safety selector assembly comprising a safety portion on at least one side of the receiver body, wherein the bolt release assembly comprises a central portion that translates in a single direction without rotating within a cavity of the receiver body.

* * * * *